US012509285B2

(12) United States Patent
Bates

(10) Patent No.: US 12,509,285 B2
(45) Date of Patent: Dec. 30, 2025

(54) RELATING TO CONTAINER CARRIERS

(71) Applicant: BRITISH POLYTHENE LIMITED, Rushden (GB)

(72) Inventor: Stephen Bates, Reading (GB)

(73) Assignee: BRITISH POLYTHENE LIMITED, Rushden (GB)

( * ) Notice: Subject to any disclaimer, the term of this patent is extended or adjusted under 35 U.S.C. 154(b) by 0 days.

(21) Appl. No.: 18/020,831

(22) PCT Filed: Aug. 12, 2021

(86) PCT No.: PCT/GB2021/052092
§ 371 (c)(1),
(2) Date: Feb. 10, 2023

(87) PCT Pub. No.: WO2022/034328
PCT Pub. Date: Feb. 17, 2022

(65) Prior Publication Data

US 2023/0286716 A1 Sep. 14, 2023

(30) Foreign Application Priority Data

Aug. 12, 2020 (GB) ..... 2012581

(51) Int. Cl.
*B65D 71/40* (2006.01)

(52) U.S. Cl.
CPC .... *B65D 71/403* (2013.01); *B65D 2571/0029* (2013.01); *B65D 2571/00666* (2013.01); *B65D 2571/00802* (2013.01)

(58) Field of Classification Search
CPC B65D 75/00; B65D 75/367; B65D 2075/363; B65D 5/4801; B65D 5/48
(Continued)

(56) References Cited

U.S. PATENT DOCUMENTS 3,488,911 A 1/1970 Jules
3,601,439 A * 8/1971 Poupitch ..... B65D 71/50 206/145

(Continued)

FOREIGN PATENT DOCUMENTS

WO 9619393 A1 6/1996
WO 9626128 A1 8/1996
WO 2019193344 10/2019

OTHER PUBLICATIONS

International (PCT) Search Report and Written Opinion for PCT/GB2021/052092 dated Nov. 25, 2021, 13 pages.

(Continued)

*Primary Examiner* — Anthony D Stashick
*Assistant Examiner* — Raven Collins
(74) *Attorney, Agent, or Firm* — Barnes & Thornburg LLP

(57) ABSTRACT

A clip type carrier for packaging articles of the type having a rim, bead, chime, undercut, waist or the like. The carrier comprises a first layer having a plurality of generally circular apertures and a second layer having a plurality of respective locking apertures. The locking apertures are provided with a plurality of locking tabs for engaging under an article rim in use. An aggregate effective aperture diameter, being approximately the generally circular aperture minus twice the thickness of the locking tabs, is greater than the diameter of the container rim, causing formation of a reinforcing rim at the periphery of the generally circular aperture once applied.

19 Claims, 26 Drawing Sheets

(58) Field of Classification Search
USPC ..... 206/148
See application file for complete search history.

(56) References Cited

U.S. PATENT DOCUMENTS

| | | | | | |
|---|---|---|---|---|---|
| 5,186,321 | A | * | 2/1993 | Fadus | B65D 71/42 206/199 |
| 5,328,024 | A | | 7/1994 | Sutherland | |
| 5,329,024 | A | * | 7/1994 | Jureller | C07D 301/12 549/531 |
| 5,485,914 | A | * | 1/1996 | Martin | B65D 71/406 206/145 |
| 5,487,464 | A | | 1/1996 | Galbierz | |
| 5,490,593 | A | | 2/1996 | Gordon | |
| 2009/0090085 | A1 | | 4/2009 | Marco | |
| 2019/0092503 | A1 | | 3/2019 | Daniel | |
| 2019/0119019 | A1 | | 4/2019 | Patton | |

OTHER PUBLICATIONS

United Kingdom Search Report for GB2012581, dated Oct. 9, 2020, 5 pages.

* cited by examiner

RELATING TO CONTAINER CARRIERS

CROSS REFERENCE TO RELATED APPLICATIONS

This application is a U.S. national stage application under 35 U.S.C. § 371(b) of International Application No. PCT/GB2021/052092 filed Aug. 12, 2021, which claims priority to the United Kingdom Patent Application No. GB2012581.1 filed on Aug. 12, 2020, the disclosures of both of which are hereby expressly incorporated by reference in their entirety.

The present invention relates generally to container carriers and particularly, although not exclusively to clip-type carriers for securely retaining containers together, and to machines, methods and systems for applying container carriers to containers.

It is well known to package containers together using a carrier. Such carriers (sometimes referred to as "carrier stock") are often formed from a plastics film with a plurality of apertures, for example as described in U.S. Pat. Nos. 2,874,835, 4,250,682 and 2,936,070.

Another type of carrier is known as a clip-type carrier, in which a sheet of flexible material engages the underside of a flange/rim of an article such as a can or bottle.

The present invention seeks to provide improvements in or relating to carriers.

An aspect of the present invention provides a carrier for packaging articles of the type having a rim or the like, comprising a first layer having a plurality of apertures and a second layer having a plurality of respective locking apertures, the locking apertures are provided with one or more locking tabs for engaging under an article rim in use, in which the layers are formed separately and are secured or securable together.

The apertures in the first layer may be generally ellipsoidal.

A further aspect provides a carrier for packaging articles of the type having a rim or the like, comprising a first layer having a plurality of apertures and a second layer having a plurality of respective locking apertures, the locking apertures are provided with one or more locking tabs for engaging under an article rim in use, in which the apertures in the first layer are generally ellipsoidal.

The first and second layers may be formed separately and may be secured or securable together.

Carriers formed in accordance with the present invention may use "castellations" on the second "locking ring" layer to support the container under the rim. Embodiments can be based on the use of an additional first layer "securing ring" which enhances container retention by restricting the flexing of the castellations together with providing additional grip during handling.

In aspects and embodiments with generally elliptical apertures, the major axis of the elliptical apertures in the first layer may be generally parallel to a longitudinal axis of the carrier.

The major axis of the elliptical apertures in the first layer may be generally parallel to a notional longitudinal axis of application of the carrier (which may or may not be the same as the longitudinal axis of the carrier).

Elliptical apertures can, for example, be used to allow "rolling on" of the carrier (as opposed, for example, to simple axial placement).

It may, for example, be preferable for elliptical apertures of the first layer to be as tight as possible to the top of the containers/castellations of the second layer upon placement to provide the castellations with the maximum retention/support once applied. If the carrier is "rolled on" to the containers it will, for example, follow the circular arc of an application drum and as a result has the effect of shortening the aperture in the direction of application. Therefore, to achieve the closest possible fit of the first layer in relation to the second layer, the use of the ellipse, in the application direction, facilitates this "close fitting" whilst allowing clearance for the aperture to pass over the trailing edge of the container as it is applied.

In some embodiments the degree of ellipticity (the degree of deviation from circularity) is small/slight. This ensures that the benefit of the elliptical apertures is present for application whilst not significantly impacting the tightness of the grip provided by the upper apertures around the castellations in use.

In one embodiment, for example, the ellipse has an approximately 54.25 mm minor axis and a 55 mm major axis e.g. approximately 1.38% difference.

Some aspects and embodiments are based on the use of a roller drum to apply carriers.

The range of drum sizes may be as follows: smallest diameter drum=528 mm; largest diameter drum=4356 mm.

Based on these drum sizes, for example the maximum range of the ellipse is approximately:

Smallest=major diameter 0.5% larger than minor diameter e.g. 54.25 mm minor diameter/54.52 mm major diameter Largest=major diameter 34.3% larger than minor diameter e.g. 54.25 mm minor diameter/72.85 mm major diameter Note: can top diameter used for these calculations is approximately 54 mm.

A smaller diameter container may be approximately 32 mm on bottles.

In some embodiments of the present invention the range may be: 0.5% to 10% major axis increase vs minor axis, for example 1% to 5%.

In some embodiments the first layer is a "top" or "upper" layer/sheet/panel.

In some embodiments the second layer is a "bottom" or "lower" layer/sheet/panel.

In some embodiments the apertures in the second layer are generally circular i.e. they may have a notional circular form, although they may be castellated.

In some embodiments the or each locking tab may be a foldable flap. the apertures in the first layer may, for example, provide a fold point for the locking tabs. The tabs may project from the second layer up and through the apertures in the first layer.

The first and second layers may be bonded, adhered or glued together, for example forming a two-layer glued laminate. The first and second layers cannot move relative to each other. This principle can be used to form a carrier that requires no gluing or manipulating during application.

In some embodiments the first and second layers are formed from the same material.

Materials, including paper, plastics, cardboard, cornstarch or potato starch, may be used to form generally flat, planar carrier layers.

In some embodiments, for example, the first and/or second layers are formed from cardboard material.

Some embodiments, for example, are formed as a 100% cardboard ring style carrier.

In other embodiments the first and second layers may be formed from different materials. This allows, for example, different properties to be provided by the two layers.

It will be understood that some embodiments are restricted to the use of two layers, but other embodiments may include more than two layers.

The first layer apertures may be dimensioned to be a tight fit around the second layer locking tabs in use. This provides resistance against flexing of the tabs in use, reducing the chance of unwanted release/detachment of containers.

The material of the first and second layers may have generally the same thickness, or they may have different thicknesses. In one embodiment, for example, both sheets have a thickness of approximately 0.35 mm.

The apertures may be dimensioned to fit under a rim, undercut, chime or the like formed on a container, such as a can (including standard beverage cans, or "slim" or "sleek" cans) or a bottle.

Examples of Standard Cans:

| UNIT SIZE | HEIGHT CLOSED | BODY DIAMETER | END SIZE (DIA) |
|---|---|---|---|
| 330 ml | 115.2 mm | 66.3 mm | 202 |
| 440 ml | 149.9 mm | 66.2 mm | 202 |
| 500 ml | 168 mm | 66.2 mm | 202 |
| 568 ml | 188.1 mm | 66.2 mm | 202 |

Examples of Slim Cans:

| UNIT SIZE | HEIGHT CLOSED | BODY DIAMETER | END SIZE (DIA) |
|---|---|---|---|
| 150 ml | 88.5 mm | 53.3 mm | 200 |
| 200 ml | 111.2 mm | 53.3 mm | 200 |
| 250 ml | 134 mm | 53.3 mm | 200 |

Examples of Sleek Cans:

| UNIT SIZE | HEIGHT CLOSED | BODY DIAMETER | END SIZE (DIA) |
|---|---|---|---|
| 250 ml | 113.9 mm | 58.1 mm | 202 |
| 330 ml | 145.4 mm | 58.1 mm | 202 |
| 355 ml | 156.9 mm | 57.6 mm | 202 |
| 450 ml | 168 mm | 63.5 mm | 202 |
| 473 ml | 173.5 mm | 63.5 mm | 202 |
| 473 ml | 173.5 mm | 63.5 mm | 206 |
| 591 ml | 193.7 mm | 66.2 mm | 206 |

In some embodiments the carrier comprises two (or more) parallel rows of apertures.

In some embodiments, between the rows and/or at the ends/sides of the carrier are provided one or more manipulation apertures and/or weight saving cut-outs.

In some embodiments carrier layers may be formed by rotary die cutting; in other embodiments punch cutting may be used, for example. Other method of manufacture, including additive manufacturing, may be used.

In some embodiments the apertures of the second layer may be castellated to provide the locking tabs.

The first and/or second layers may be formed as generally rectangular or generally square sheets.

In some embodiments the carrier may further comprise one or more marketing panels formed along one or more sides of the first and/or second layers.

In some embodiments the carrier may further comprise a handle.

Some embodiments may further comprise a cover film, for example for covering the first layer.

The cover film may be a peelable film, so as to be peelable away from the first layer in use. Easy separation could be useful to provide improved recyclability when there are mixed materials.

The cover film may have anti-microbial properties.

The present invention also provides a continuous strip of a plurality of carriers as described herein i.e. a plurality of carriers may be formed together and then can be separated either before or at the point of application.

A strip of carriers may, for example, comprise perforations for separating carriers.

The strip may be formed in a fan foldable or fan folded format.

The present invention also provides a multipack bottle or can carrier comprising a carrier as described herein.

The present invention also provides a carrier as described herein in combination with a plurality of container to form a multi-pack; for example a 4-pack of 500 ml cans.

The carrier may be suitable for or adapted to be rolled onto containers.

The carrier may be suitable for or adapted to be pushed/pressed onto containers.

The present invention also provides a method of rim-applying unitising clip-type container carriers to containers, comprising the steps of: providing an application station comprising a roller drum which rollingly applies carriers to containers; providing a conveyor system for transporting containers and feeding them to and through the application station; providing clip-type carriers having a number of apertures for holding a number of containers; and the roller drum in use receiving carriers from a supply system and rollingly urging them onto the containers so that the tabs engage under the rims.

This method allows for carriers to be applied using a method of continuous "rolling on" of the product.

The clip-type container carriers may comprise carriers as described herein.

The conveyor system may include a caterpillar drive for timing the position of containers with respect to a roller drum. The caterpillar drive may engage the sides of the containers and allows the position of the containers to be known in relation to the apertures of a waiting carrier. The movement of the containers can thereby be coincided with rotation of the application drum. In addition the caterpillar drive can be used to hold the containers in position as they pass into and through the application station.

In some embodiments the carriers may be pre-separated; however, in other embodiments the carriers may also be separated at the application station. For example the roller drum may comprise a separator means such as cutting blades for separating carriers. In embodiments with a caterpillar drive or the like the drive can also be used to hold the containers as the carrier is separated from the trailing carrier in a continuous stream.

Some aspects and embodiments provide or relate to a board-based carrier.

One or more apertures in the first (e.g. top) layer may be generally ellipsoidal.

One or more apertures in the first (e.g. top) layer may be generally circular.

One or more apertures in the second (e.g. bottom) layer may be generally ellipsoidal.

One or more apertures in the second (e.g. bottom) layer may be generally circular.

Ellipsoidal apertures may, for example, be useful for assist in a "rolling on" method of application of carriers.

In some embodiments a simple push down method of application can be used, which may negate the need for the ellipsoidal apertures. This may, for example, open up the opportunity of using smaller circular apertures on the top sheet. This has the benefits off creating an even tighter grip on the container (e.g. can tops).

In some aspects and embodiments the diameter of the apertures in the "top" sheet (the first layer) of material is "reduced". For example the diameter of the apertures on the top sheet may be "undersized" i.e. deliberately smaller than the diameter of the part of the container over which they must pass.

An aspect of the present invention provides a carrier for packaging articles of the type having a rim or the like, comprising a first layer having a plurality of circular apertures and a second layer having a plurality of respective locking apertures, the locking apertures are provided with one or more locking tabs for engaging under an article rim in use, in which aggregate apertures formed by the circular apertures and the locking tab material are smaller than the packaging article rim, causing formation of a bent aperture rim at the periphery of the circular apertures once applied.

A further aspect provides a clip-type carrier for packaging articles of the type having a rim, chime, waist, undercut or the like, comprising a first layer having a plurality of generally circular apertures and a second layer having a plurality of respective locking apertures, the locking apertures are provided with a plurality locking tabs which fold through the generally circular apertures and engage an article rim or the like in use, in which the interior periphery of the circular apertures is formed with or configured to provide a reinforcing rim which supports the locking tabs so as to resist deformation thereof.

In some embodiments a subtractive aperture diameter of D1 minus twice the thickness of the locking tabs is less than the diameter of the container rim. In other words, the effective aperture size, created by the aperture of the upper layer in combination with the retaining flaps that fold through and sit adjacent the inner periphery of the upper layer aperture, is less than the size of part of a container over which the cumulative aperture must pass over. For example D1 may be greater than D2, or D1 may be equal to or less than D2 but then the inclusion of the retaining flaps reduces the effective aperture size to be greater than D2.

In some embodiments $D1-2T<D2$, where D1 is the upper aperture diameter, D2 is the diameter of the container rim and T is the thickness of the material of the second layer locking tabs.

In some embodiments the diameter D1 of the circular apertures are dimensioned according to formula $D1<D2-$at least 2T, where D2 is the diameter of the container rim and T is the thickness of the material of the second layer locking tabs.

In some aspects and embodiments carriers are provided which use a generally circular aperture on the first layer that has the range of: size of the top of the can (e.g. 54 mm) to size of top of the can minus approximately twice the thickness of board used (e.g. 0.25 mm=53.5 mm approx.). In effect, as the carrier is pushed down over the top of the can there is two thicknesses of material (i.e. each side of the top aperture) which must be passed over and therefore the aggregate aperture is actually smaller than the can top and material combination it is having to pass over.

A further benefit of using such a tight aperture is the ability to replace removed cans.

In some embodiments circular apertures are dimensioned (using formula: $D1<D2-2T$) to result in formation of a ridge/crease/fillet when applied, which significantly improves retention. D2 is the diameter of the top of the container; D1 is the diameter of the aperture; T is the thickness of each of the locking lugs.

The size range of apertures may, for example be generally defined by the following:

$$D1-2T<D2$$

$$D2>D1-2T$$

$$D1=D2+4t$$

$$D1=D2-4t$$

$$\text{or } D1=D2+/-4t$$

In some embodiments the apertures in the upper layer, when combined with the thickness of the locking lugs that are folded therethrough, have an aggregate diameter which is less that the diameter of the container over which the carrier will pass.

The upper layer apertures may be approximately defined by one or more of the following:

$$D1<D2$$

$$D1<D2-0.5T$$

$$D1<D2-T$$

$$D1<D2-2T$$

$$D1<D2-4T$$

In some embodiments the carrier may be formed according to a principle of D1−2T (the aggregate aperture size) must be less than D2. In other words, the container must have a dimension (D2) which is greater than the aggregate aperture size; this inter-dimension difference causes formation of the bent rim at the periphery of the upper layer aperture. In effect, the aggregate aperture is "too small" to fit over D2 and accordingly the aperture rim is deformed.

In an axial sense, D2 could be present at any point on the container along the length over which the carrier passes to reach an applied condition. For example D2 could be provided by a rim or the like and/or by a sidewall. Some embodiments, for example have a rim and then a conical/inclined wall section; the rim and/or a point on the wall could provide D2.

The aperture bead, once formed, may help to prevent deformation of retention flaps/lugs.

References to D1 and/or T and/or D2 may be in respect of applied and/or unapplied dimensions.

A further aspect provides a carrier for packaging articles of the type having a rim or the like, comprising a first layer having a plurality of circular apertures and a second layer having a plurality of respective locking apertures, the locking apertures are provided with one or more locking tabs for engaging under an article rim in use, in which the circular apertures are smaller than the combination of the packaging article rim and the locking tab material it passes over, causing formation of a bent/deformed/folded aperture rim at the periphery of the aperture once applied.

A further aspect provides a clip-type carrier for packaging articles of the type having a rim, chime, waist, undercut or the like, comprising a first layer having a plurality of generally circular apertures and a second layer having a plurality of respective locking apertures, the locking apertures are provided with a plurality locking tabs which fold through the generally circular apertures and engage an article rim or the like in use, in which the interior periphery of the circular apertures is formed with or configured to provide a bent aperture rim which supports the locking tabs so as to resist deformation thereof.

A further aspect provides a carrier for packaging articles of the type having a rim or the like, comprising a first layer having a plurality of circular apertures and a second layer having a plurality of respective locking apertures, the locking apertures are provided with one or more locking tabs for engaging under an article rim in use, in which aggregate apertures formed by the circular apertures and the locking tab material are smaller than the packaging article rim, causing formation of a bent aperture rim at the periphery of the circular apertures once applied.

The bent rim may be partly or fully formed as the carrier is applied, or may be at least partly pre-formed.

The diameter D1 of the circular apertures may be dimensioned according to formula D1<D2 minus at least 2T, where D2 is the diameter of the container rim and T is the thickness of the material of the second layer.

In some embodiments D1=D2−4T.

The first and second layers may be formed separately and are secured or securable together.

The first and second layers may be, for example, adhered, bonded or glued together in advance of application or at the time of application.

The layers may be secured together using re-pulpable adhesive.

The or each locking tab may be a foldable flap.

The first and second layers may be formed from the same material.

The first and second layers may be formed from different materials.

The apertures in the first layer may provide a fold point for the locking tabs.

The material of the first and second layers may have the same, substantially the same or a different thickness.

Apertures of the second layer may be castellated to provide the locking tabs.

The first and/or second layers may be formed from cardboard material.

The first and second layers may be generally rectangular or square sheets.

The carrier may comprise one or more marketing panels formed along one or more sides of the first and/or second layers.

The carrier may further comprise a handle.

The carrier may further comprise a cover film for covering the first layer.

The cover film may be peelable away from the first layer.

A further aspect provides a clip-type carrier for packaging articles of the type having a rim, chime, waist, undercut or the like, comprising a first layer having a plurality of generally circular apertures and a second layer having a plurality of respective locking apertures, the locking apertures are provided with a plurality locking tabs which fold through the generally circular apertures and engage an article rim or the like in use, in which first and/or second layers include one or more folds that form panels or flaps.

The fold may include tension means for causing tension therein in a folded condition, for example so as to hold the flap/panel in the folded condition.

A further aspect provides a carrier for unitising a plurality of packaging articles, the carrier including a plurality of apertures for receiving articles, in which the carrier includes a fold that forms a panel or flap and in which the fold includes tension means for causing tension therein so as to hold the flap in a folded condition.

The carrier may, for example, be formed from paperboard or cardboard material. In other embodiments the carrier may be formed from a plastics material.

The carrier may retain articles such as cans, bottles and the like.

The present invention also provides a continuous strip of a plurality of carriers as described herein. The strip may comprise perforations for separating carriers. The strip may be formed in a fan foldable or fan folded format.

Further aspects and embodiments are listed in the following numbered paragraphs.

1. A carrier for packaging articles of the type having a rim or the like, comprising a first layer having a plurality of apertures and a second layer having a plurality of respective locking apertures, the locking apertures are provided with one or more locking tabs for engaging under an article rim in use, in which the layers are formed separately and are secured or securable together.
2. A carrier as claimed in paragraph 1, in which the apertures in the first layer are generally ellipsoidal.
3. A carrier for packaging articles of the type having a rim or the like, comprising a first layer having a plurality of apertures and a second layer having a plurality of respective locking apertures, the locking apertures are provided with one or more locking tabs for engaging under an article rim in use, in which the apertures in the first layer are generally ellipsoidal.
4. A carrier as claimed in paragraph 2 or paragraph 3, in which the major axis of the elliptical apertures in the first layer is generally parallel to a longitudinal axis of the carrier.
5. A carrier as claimed in any of paragraphs 2 to 4, in which the major axis of the elliptical apertures in the first layer is generally parallel to a longitudinal axis of application of the carrier.
6. A carrier as claimed in any of paragraphs 3 to 5, in which the first and second layers are formed separately and are secured or securable together.
7. A carrier as claimed in any preceding paragraph, in which the apertures in the second layer are generally circular.
8. A carrier as claimed in any preceding paragraph, in which the or each locking tab is a foldable flap.
9. A carrier as claimed in any preceding paragraph, in which the first and second layers are adhered, bonded or glued together prior to or at the time of/during application.
10. A carrier as claimed in any preceding paragraph, in which the first and second layers are formed from the same material.
11. A carrier as claimed in any of paragraphs 1 to 9, in which the first and second layers are formed from different materials.
12. A carrier as claimed in any preceding paragraph, in which the apertures in the first layer provide a fold point for the locking tabs.
13. A carrier as claimed in any preceding paragraph, in which the first layer apertures are dimensioned to be a tight fit around the locking tabs in use.
14. A carrier as claimed in any preceding paragraph, in which the material of the first and second layers has a different thickness.

15. A carrier as claimed in any preceding paragraph, in which apertures of the second layer are castellated to provide the locking tabs.
16. A carrier as claimed in any preceding paragraph, in which the first and/or second layers are formed from cardboard material.
17. A carrier as claimed in any preceding paragraph, in which the first and second layers are generally rectangular or square sheets.
18. A carrier as claimed in any preceding paragraph, further comprising one or more marketing panels formed along one or more sides of the first and/or second layers.
19. A carrier as claimed in any preceding paragraph, further comprising a handle.
20. A carrier as claimed in any preceding paragraph, further comprising a cover film for covering the first layer.
21. A carrier as claimed in paragraph 20, in which the cover film is peelable away from the first layer.
22. A continuous strip of a plurality of carriers as claimed in any preceding paragraph.
23. A strip as claimed in paragraph 22, comprising perforations for separating carriers.
24. A strip as claimed in paragraph 22 or paragraph 23, formed in a fan foldable or fan folded format.
25. A method of rim-applying unitising clip-type container carriers to containers, comprising the steps of:
    providing an application station comprising a roller drum which rollingly applies carriers to containers;
    providing a conveyor system for transporting containers and feeding them to and through the application station;
    providing clip-type carriers having a number of apertures for holding a number of containers; and
    the roller drum in use receiving carriers from a supply system and rollingly urging them onto the containers so that the tabs engage under the rims.
26. A method of applying carriers as described herein.
27. A close-fitting pusher plate for applying carriers, comprising retaining clamps to hold the carrier and prevent the corners of the carrier deforming during application.
28. A clip type carrier for packaging articles of the type having a rim, bead, chime or the like, the carrier comprises a first layer having a plurality of circular apertures and a second layer having a plurality of respective locking apertures, the locking apertures are provided with a plurality of locking tabs for engaging under an article rim in use, the circular apertures are smaller than the combination of the packaging article rim and the locking tab material it passes over, causing formation of a bent aperture rim at the periphery of the aperture once applied.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims. Each aspect can be carried out independently of the other aspects or in combination with one or more of the other aspects.

The present invention will now be more particularly described, by way of example, with reference to the accompanying drawings.

The example embodiments are described in sufficient detail to enable those of ordinary skill in the art to embody and implement the systems and processes herein described. It is important to understand that embodiments can be provided in many alternative forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

In the following description, all orientational terms, such as upper, lower, radially and axially, are used in relation to the drawings and should not be interpreted as limiting on the invention.

FIG. 1 shows a clip-type carrier generally indicated 10.

As shown in FIGS. 2 and 3 the carrier is formed from first, upper layer 20 and a second, lower layer 15. The layers 15, 20 have approximately the same generally rectangular outline shape.

The lower layer 15 is formed with six (in this embodiment) retaining apertures 25*a-f*, provided in two parallel rows of three. Each of the apertures 25*a-f* is generally circular and at their periphery have a plurality of radially extending slits 30 which define a plurality of retaining lugs 35.

Along the centre of the layer 15 are two generally circular holes 40, 42, used both as finger holes and also to manipulate the carrier during application. It will be noted that at the ends of the carrier there are semi-circular holes 44, 46 because in this embodiment the carrier is formed in a continuous strip with other such carriers, so the holes at either end are bisected.

The upper layer 20 is formed with six apertures 50*a-f*, provided in two parallel rows of three and corresponding to respective apertures 25*a-f* of the first layer.

Referring also to FIG. 4, in this embodiment each of the apertures (on 50*a* is shown) is generally elliptical. The major axis Y of the apertures is shown and runs parallel to the axis of carrier application X shown in FIG. 1. To aid understanding a notional circular aperture is shown in dotted lines.

Again corresponding to the first layer, along the centre of the layer 20 are two generally circular holes 55, 57 and the ends of the carrier also have semi-circular holes 59, 61.

The layers/sheets 15, 20 are formed separately and secured together, in this embodiment by gluing. The sheets cannot therefore move relative to each other.

The length of the slits in the apertures 25*a-f* means that they extend at least to the edge of the apertures 50*a-f*, as can be seen in FIG. 1.

FIG. 5 shows a carrier 110 of the general type described in relation to FIG. 1 to 4 and applied to six standard sized beverage cans 170.

It will be seen that the lugs 135 are deflected upwards and engage under the can end chimes 175. The lugs 135 are prevented from deformation by the presence of the apertures in the second layer, which effectively act like a collar.

Unlike standard cans, sleek and slim cans typically do not include a pronounced frusto-conical upper portion below a chime (meaning that the diameter of the end is very similar to the diameter of the body; typically only slightly larger). As a result, with the cans fitted into a carrier and sitting close to each other, there is very little carrier material between them. In addition, it is often preferable to have no or only a very small overhang at the edges of the carrier or else they cannot be stacked together efficiently. The result is that there would be very little carrier material around the cans, which would increase the risk of the material tearing.

Figure 7A:
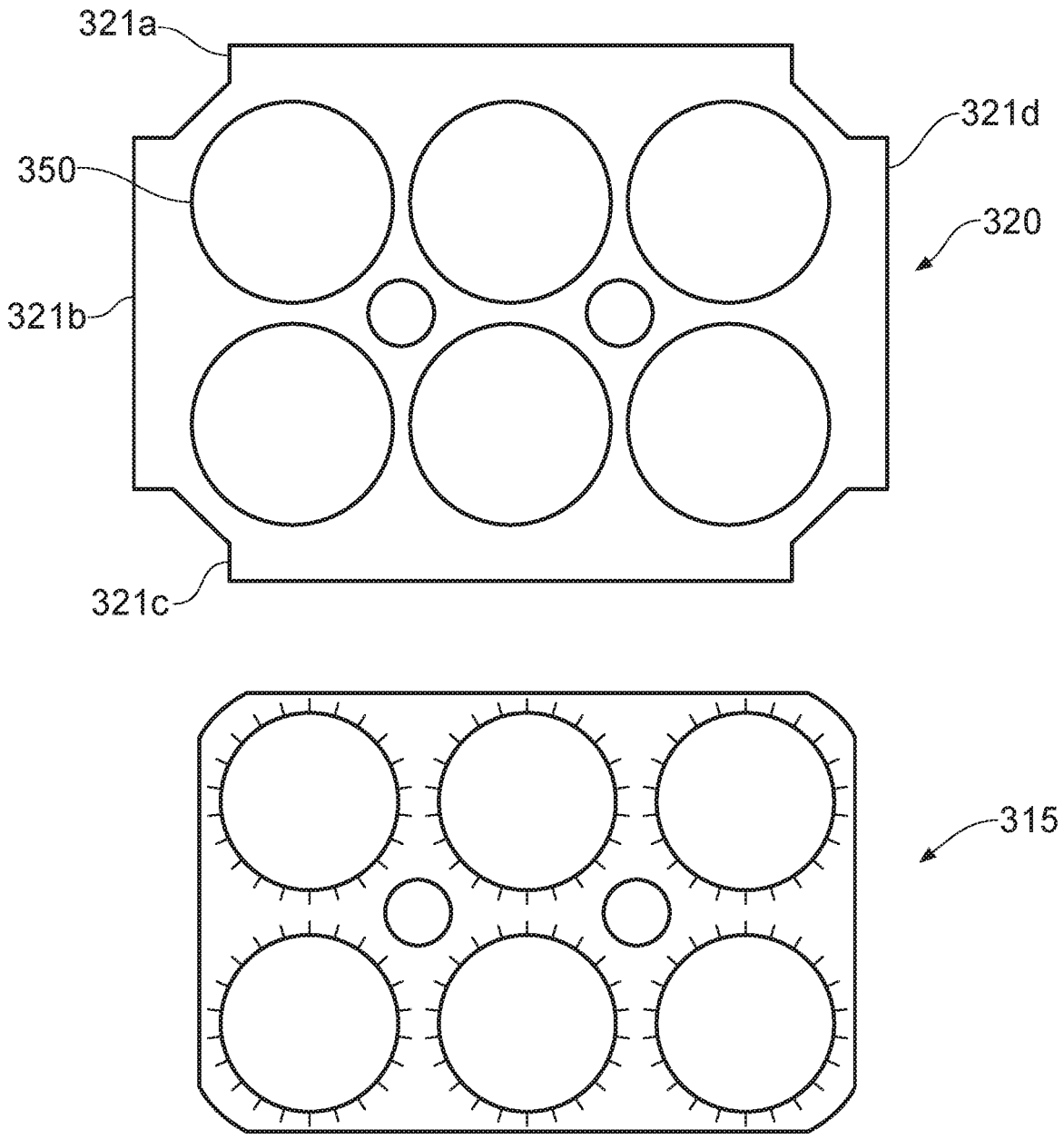
FIG. 7A shows first and second layers 320, 315 of a carrier formed according to a further embodiment. This embodiment is designed for "sleek cans" or "slim cans", having a smaller diameter than a standard can.

To address this potential problem, the embodiment of FIG. 7A provides additional material flaps 321*a-d* along each edge of the upper layer 320.

Figure 1:
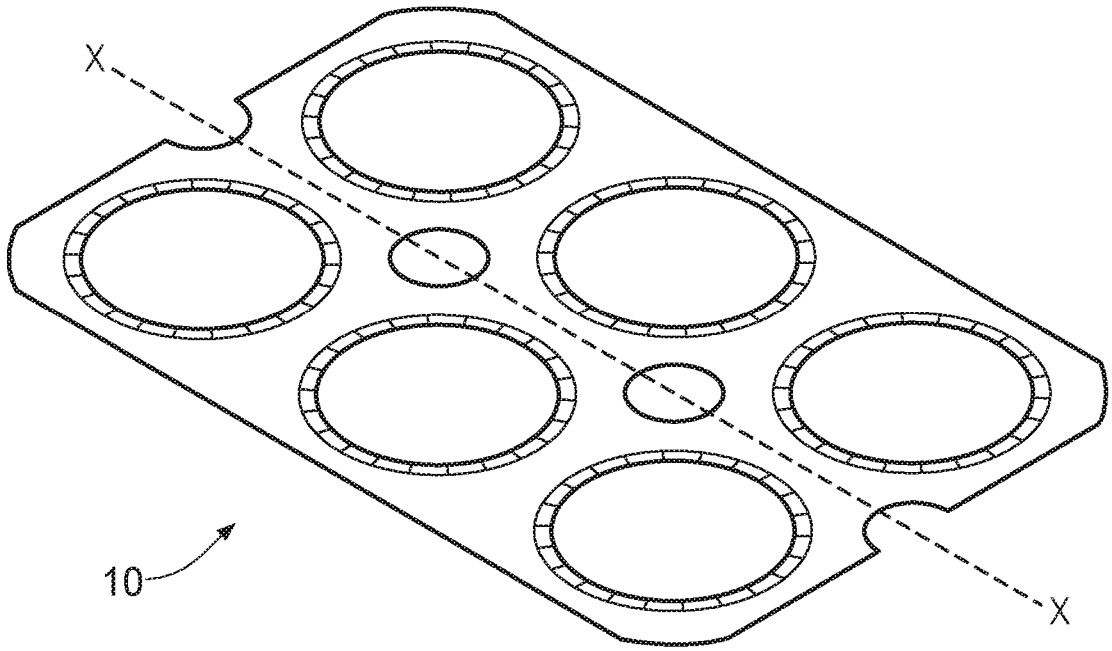
Figure 2:
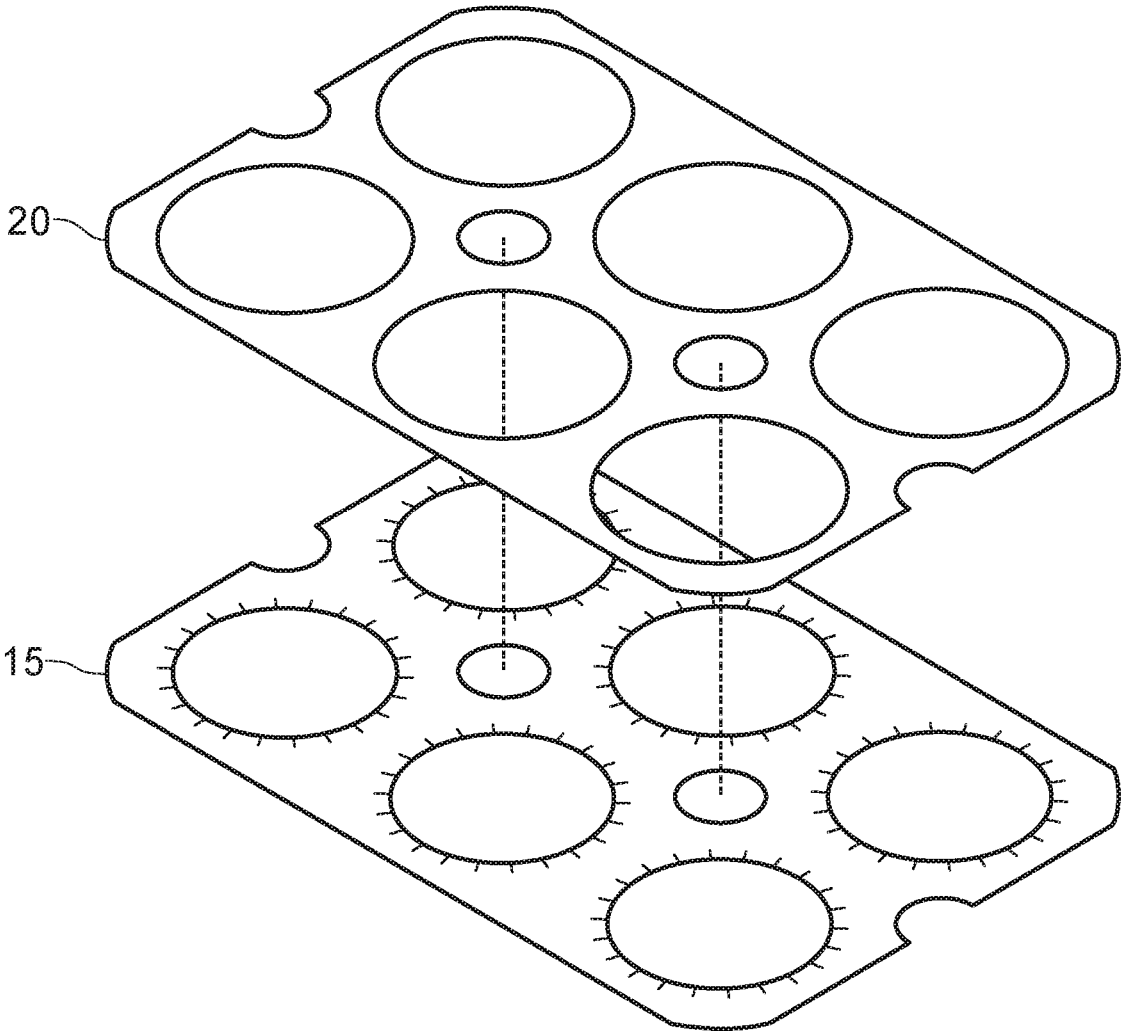
Figure 3:
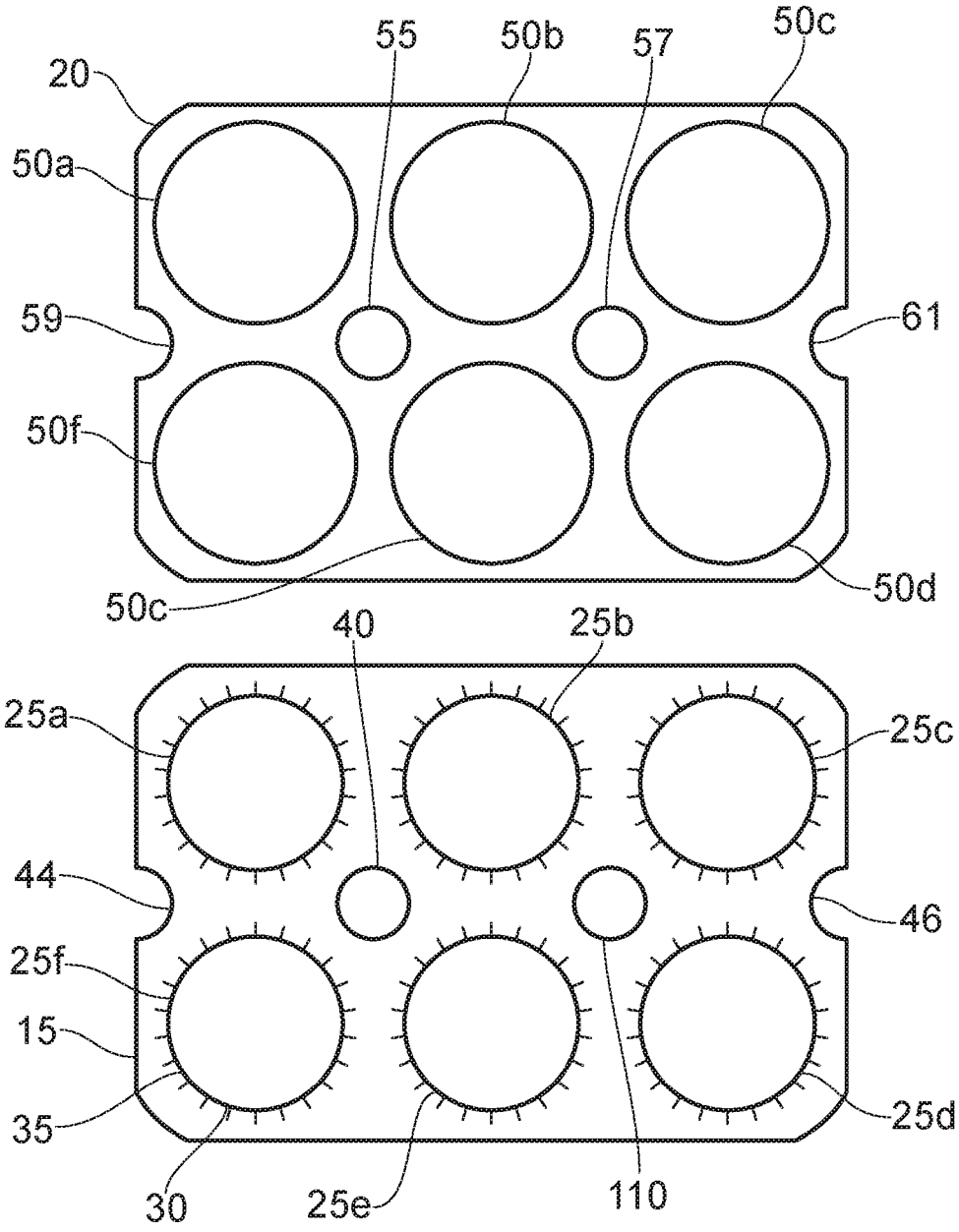
Figure 4:
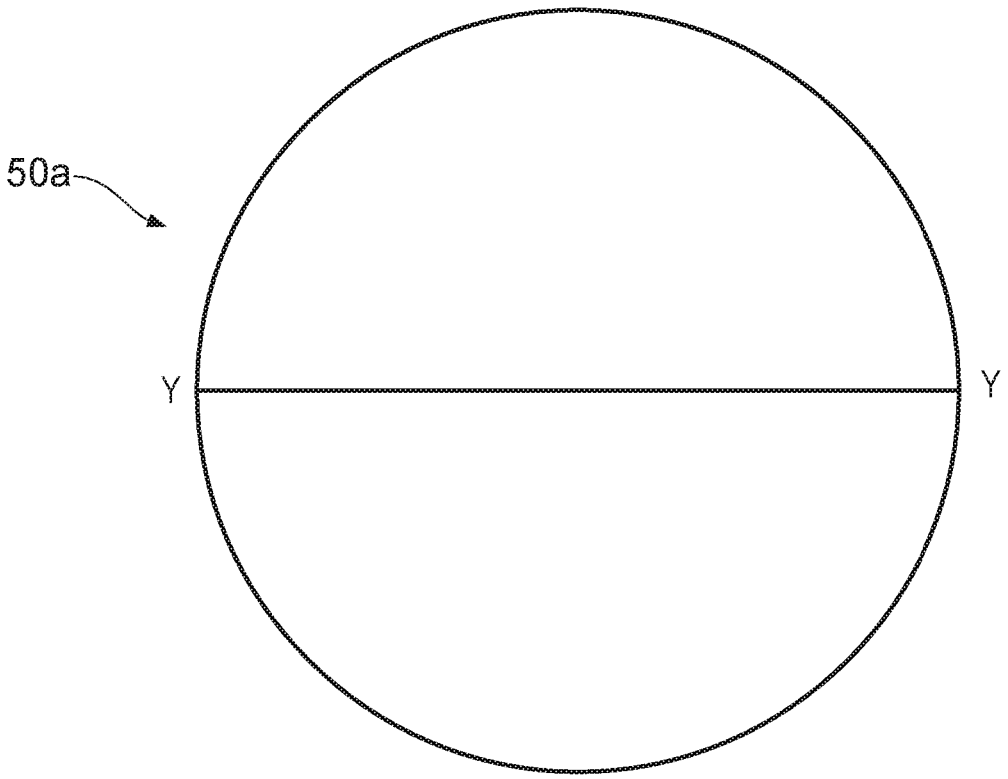
Figure 5:
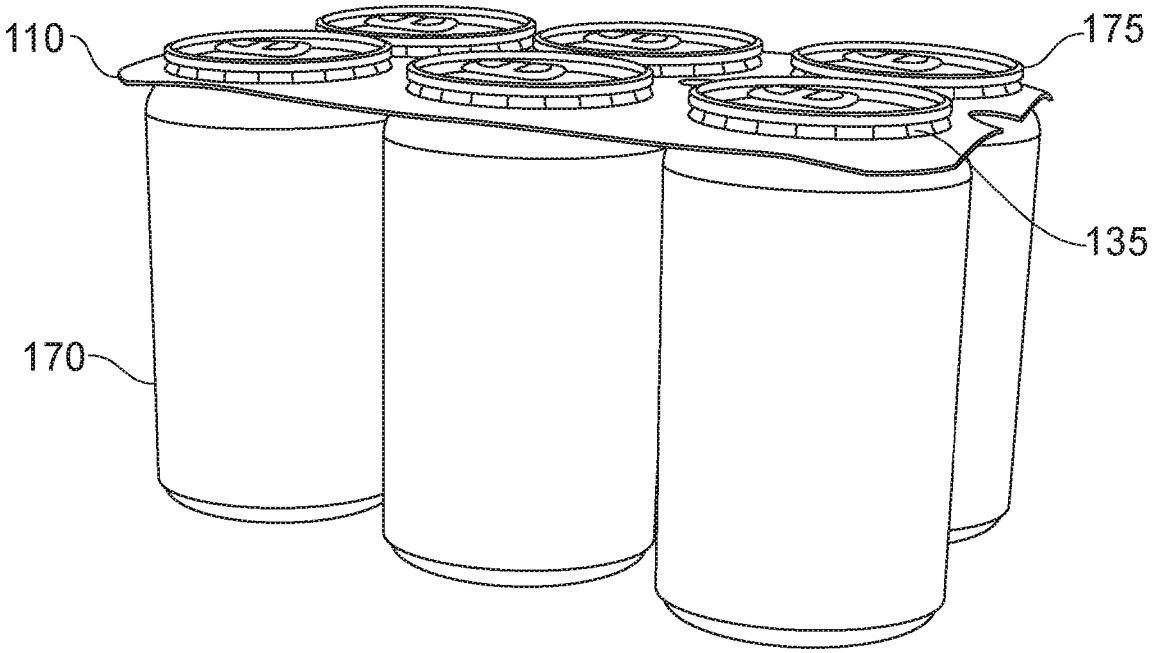
Figure 6:
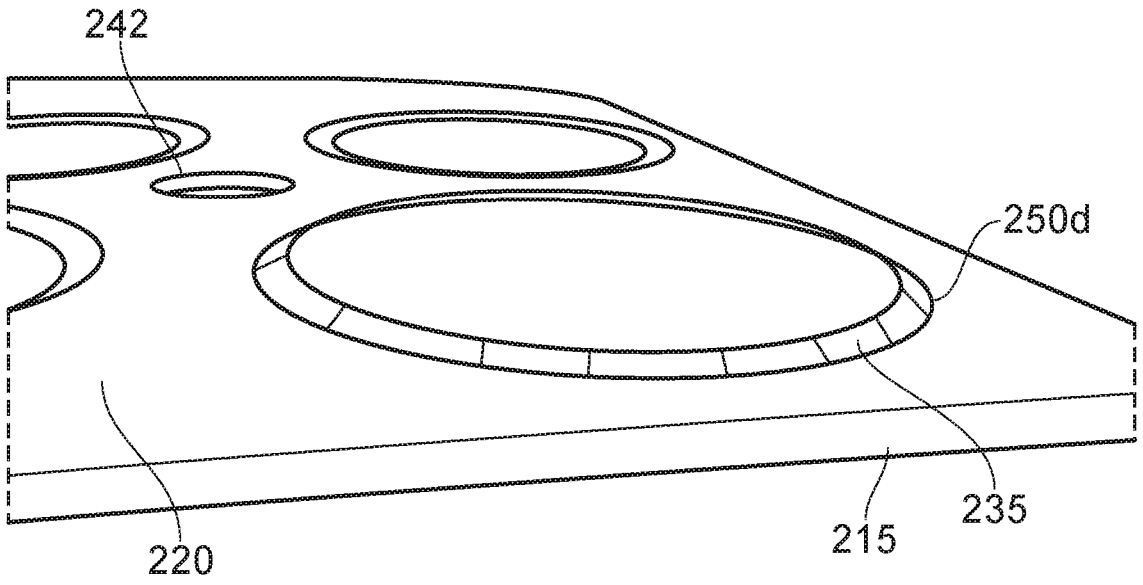
FIG. 6 illustrates a close-up of an aperture 250*d* with lugs 235 deflected upwards.
Figure 7B:
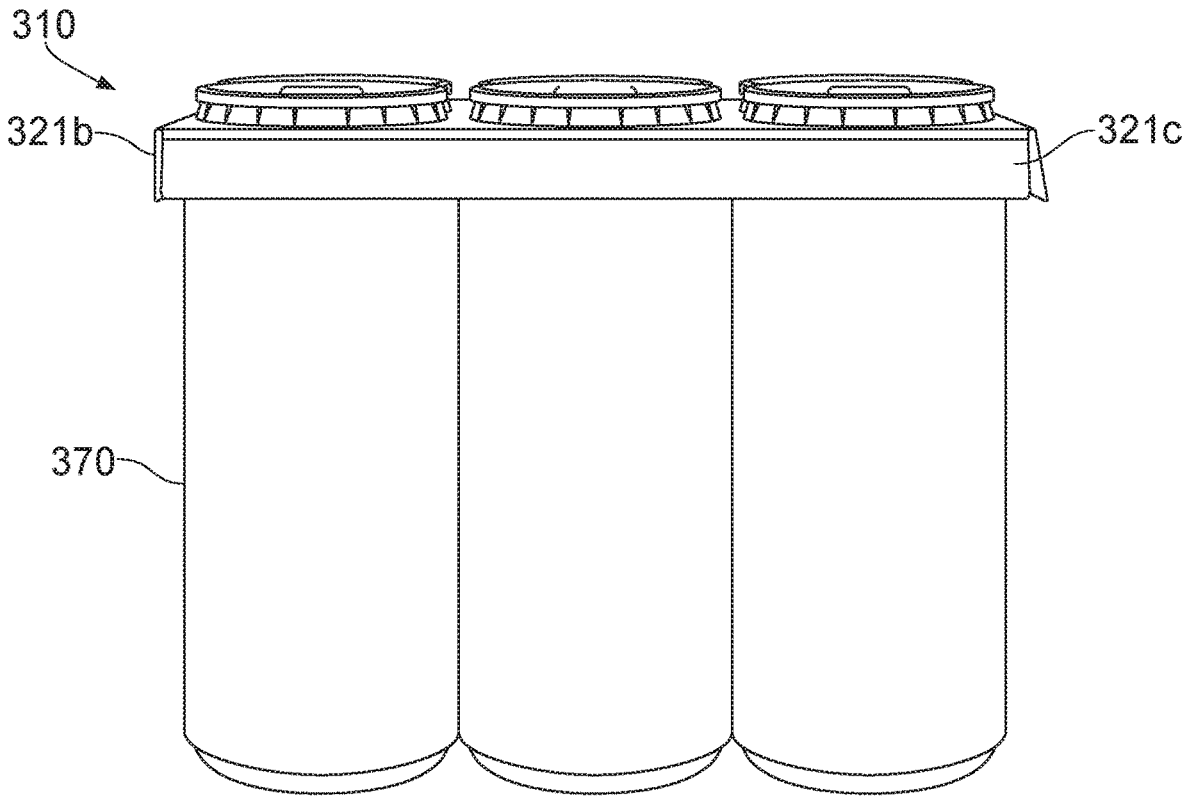

The principle of the carrier 310 formed from layers 320, 315 is generally the same as that for the carrier 110 described in relation to FIG. 5, for example. A carrier 310 of this type is shown applied to six sleek beverage cans 370 in FIG. 7B. The flaps 321 are folded down (by approximately 90 degrees) so that that lie generally flat against the side of the cans. In this embodiment the flaps are folded during application; in other embodiments the flaps may be pre-folded.

In this embodiment the apertures 350 in the upper layer 320 are generally circular.

Figure 8:
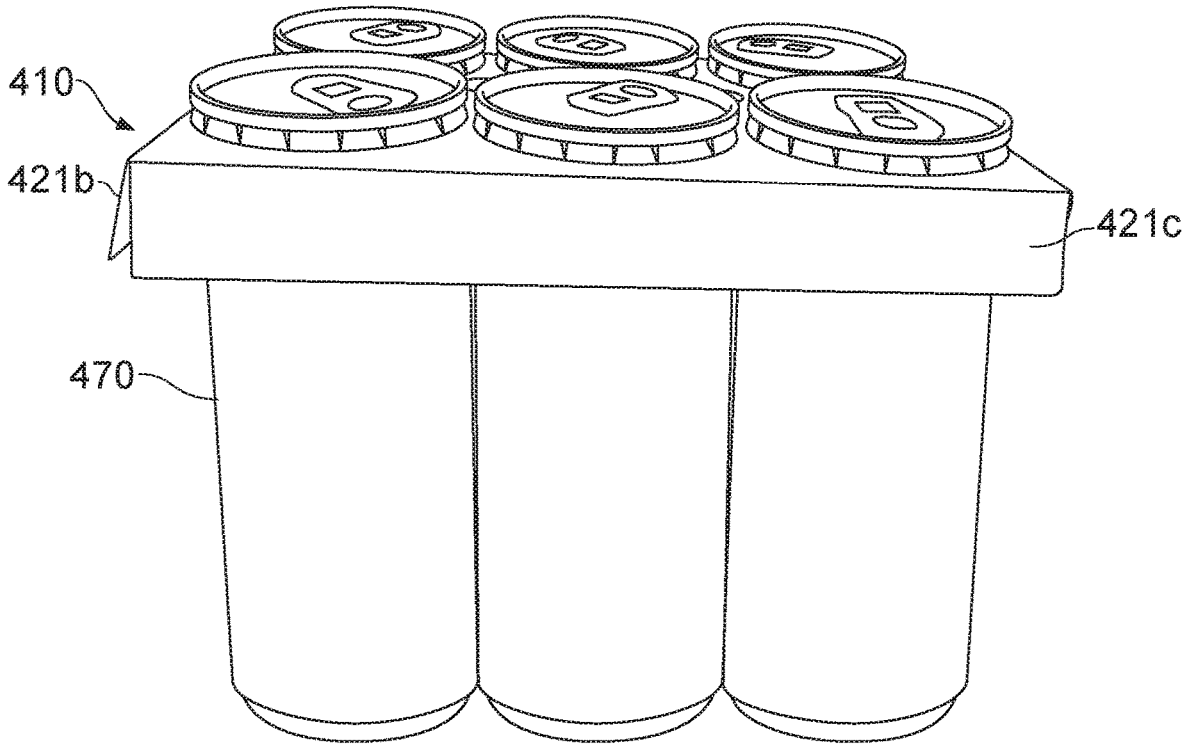

FIG. 8 shows a carrier 410 formed in accordance with the present invention and applied to six slim can 470. The carrier 410 is similar to the carrier 310, with extra material flaps 421 provided along each edge.

Figure 9:
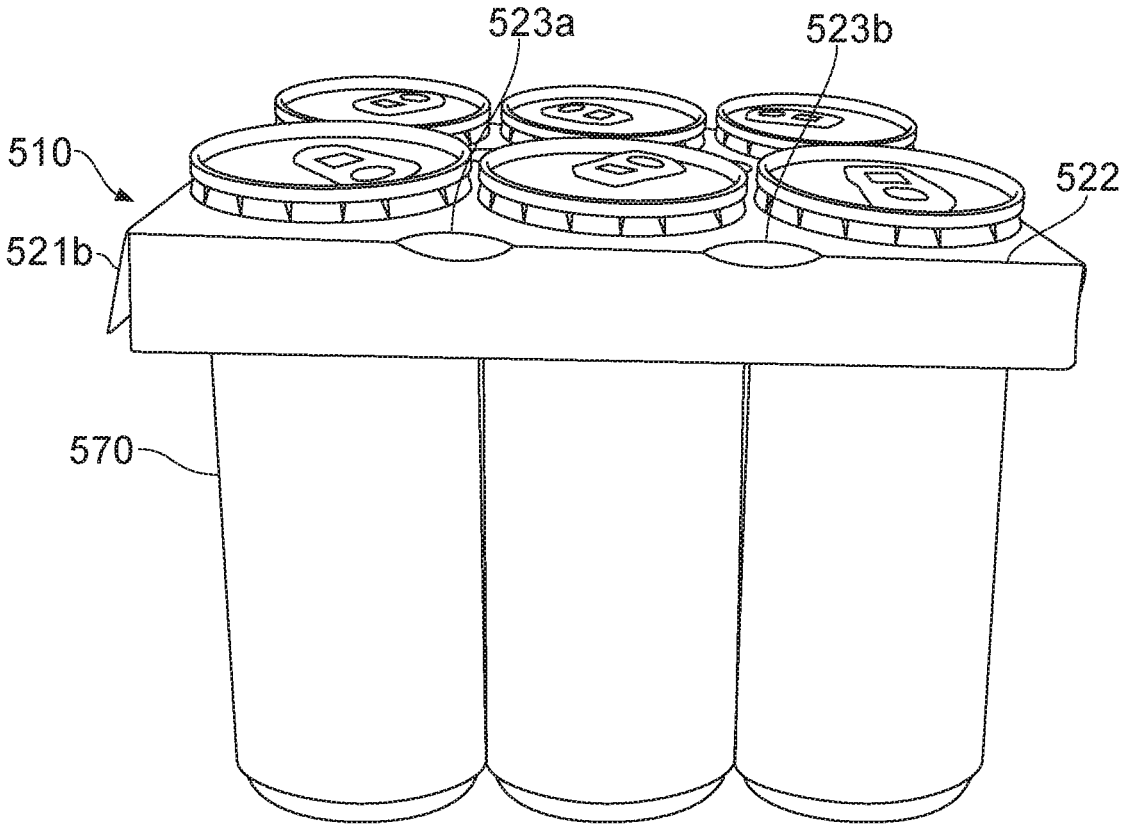

FIG. 9 shows a carrier 510 formed according to a further embodiment. The carrier 510 is similar to the carrier 410 and is shown applied to slim cans 570.

The folds which form the flaps are provided with tensioning means. In this embodiment, for example, the fold line 522 along which the upper layer is folded to form the flap includes two elongated elliptical shaped panels (reminiscent of a marquise shape) 523*a*, 523*b*. When the flap is folded the panels introduce tension into the fold line, which holds the flaps in position (i.e. prevents it from rising up/unfolding) and means that the flap is held alongside the cans.

Figure 10C:
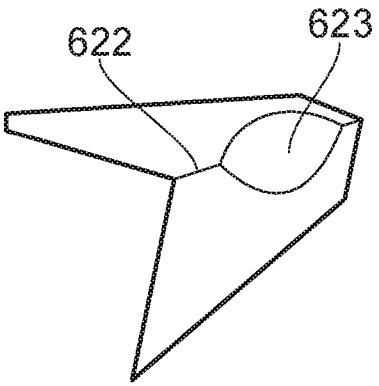
Figure 10A:
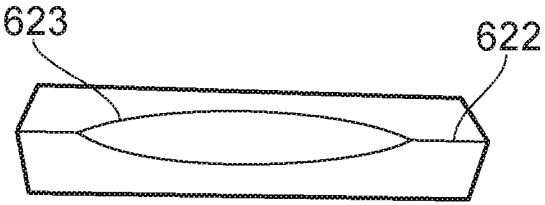
Figure 10B:
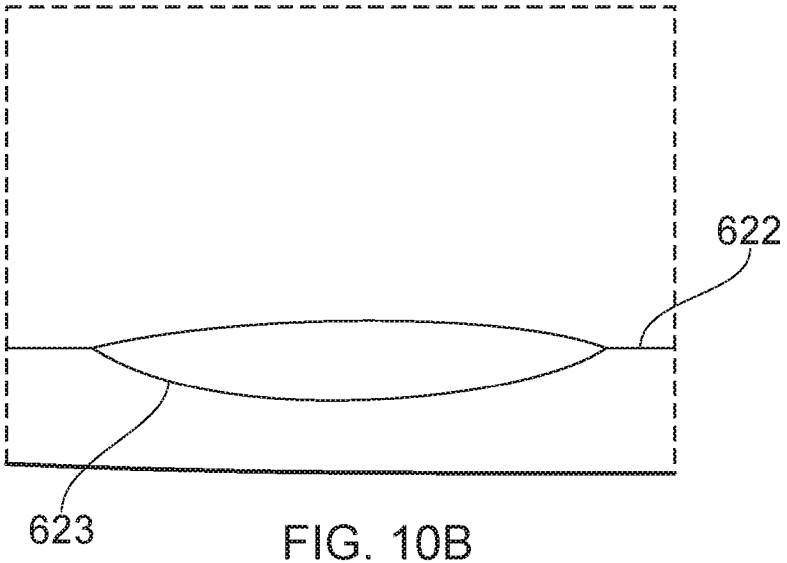

FIGS. 10A to 10C illustrate a fold formed in accordance with the present invention. The fold line 622 includes an elongated elliptical panel 623. This places the fold line under tension and provides a stable folded configuration.

Figures 11A, 11B, 11C:
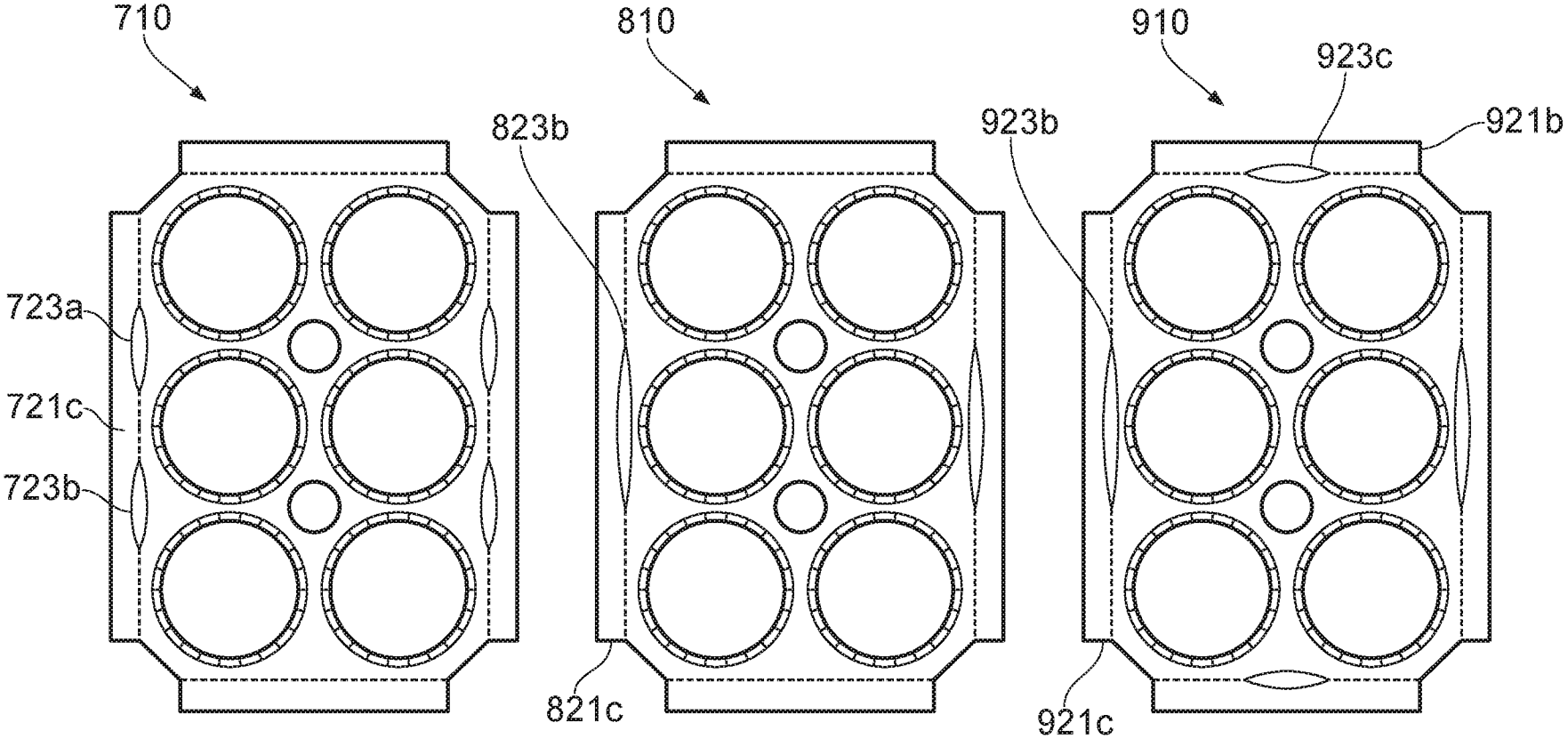

FIGS. 11A to 11C show carriers 710, 810, 910 formed according to further embodiments. The carrier 710 is generally rectangular and the flaps along the longer sides each have two spaced elliptical tensioning panels. The carrier 810 has a single elliptical panel along the fold line of each longer side flap. The carrier 910 has a single elliptical panel along the fold line of each longer side flap and a single elliptical panel forming part of the fold of each shorter side.

Figure 12B:
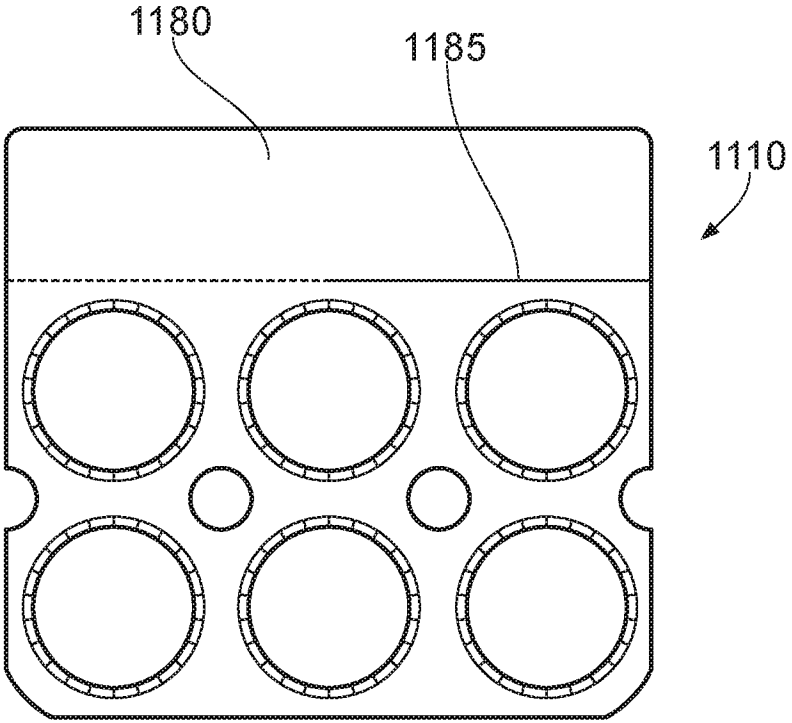
Figure 12A:
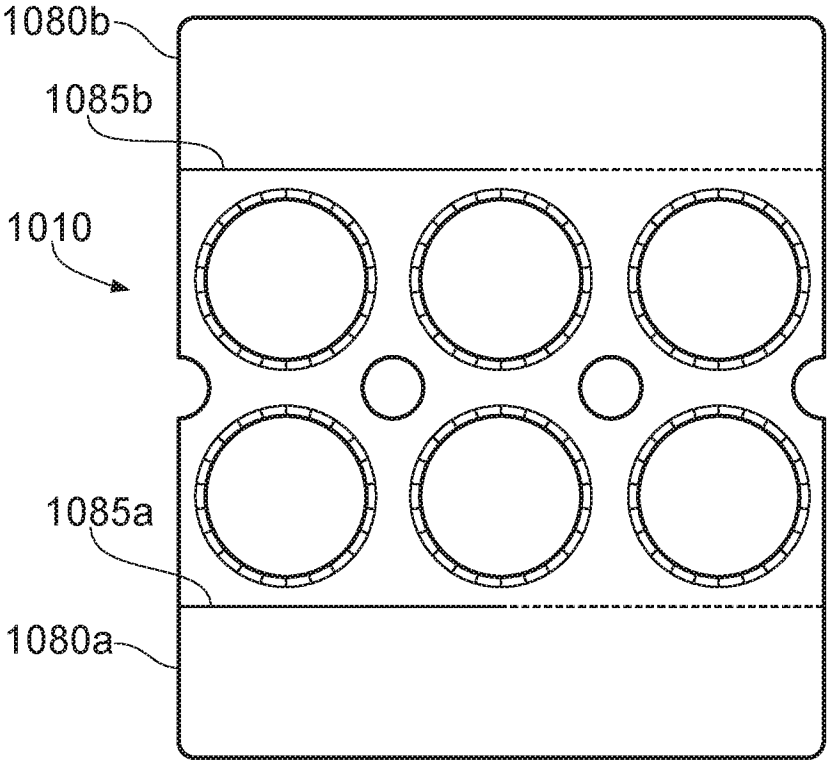

FIG. 12A shows a carrier 1010 formed according to a further embodiment. The carrier 1010 is similar to the carriers 10 and 110. In this embodiment the longer sides of the bottom layer are extended to form panels 1080*a*, 1080*b*, which could be used, for example, as a merchandising/advertising space. The carrier 1010 is folded along lines 1085*a*, 1085*b* to form the panels 1080*a*, 1080*b*.

The carrier 1110 of FIG. 12B is similar to the carrier 1010 of FIG. 12A, except that only one panel 1180 is provided.

Figure 13:
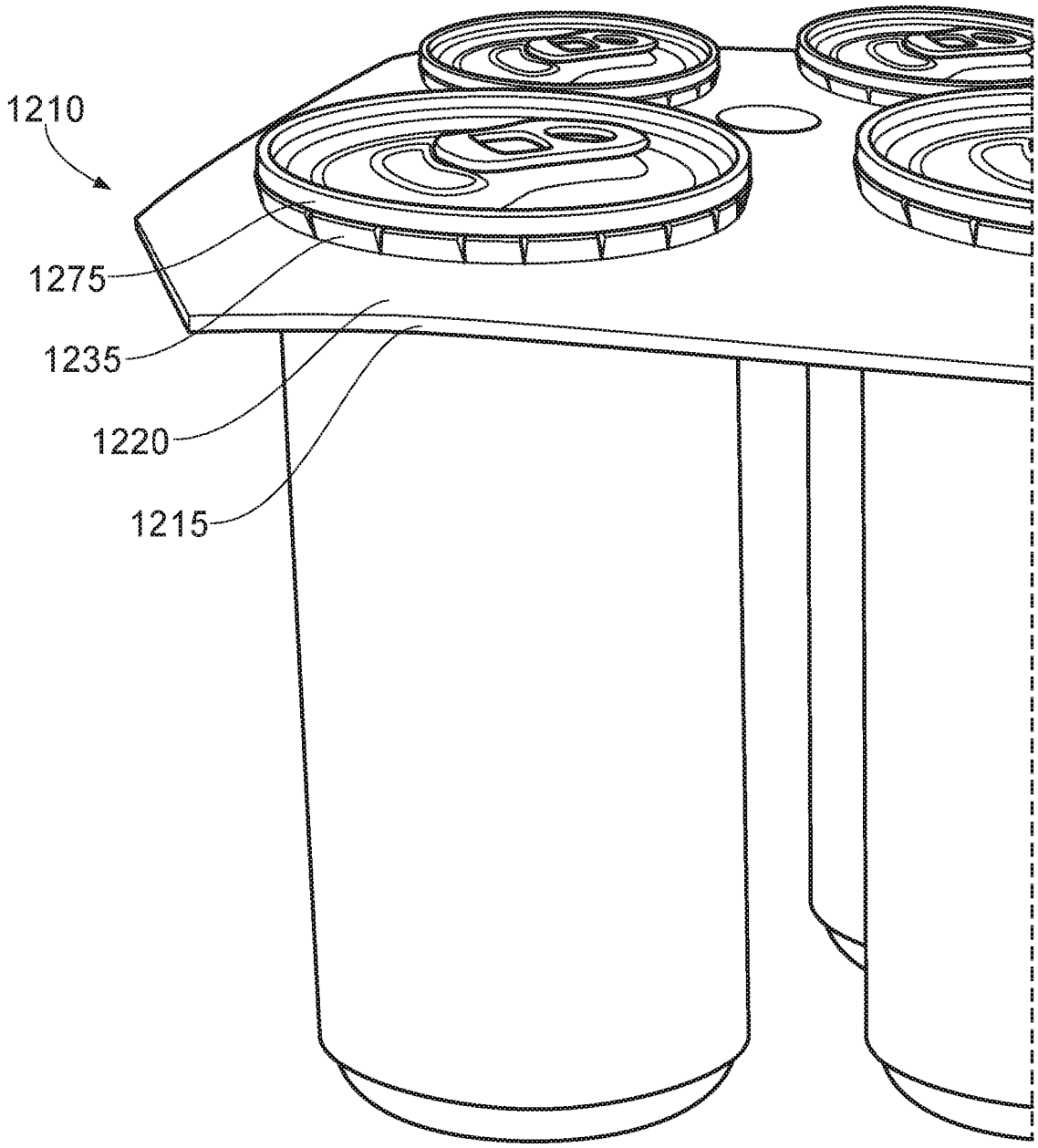
Figure 14C:
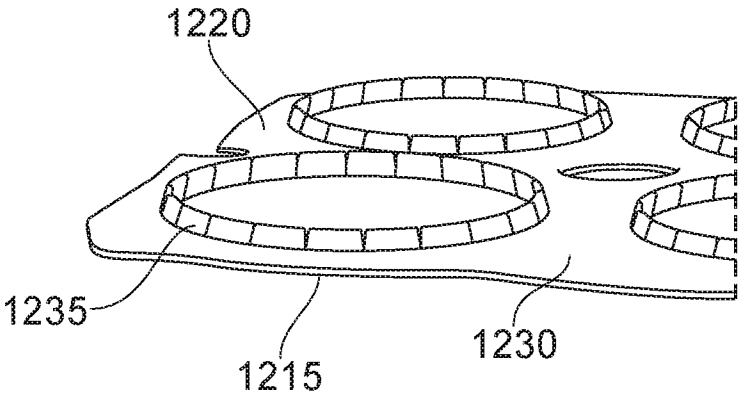
Figure 14D:
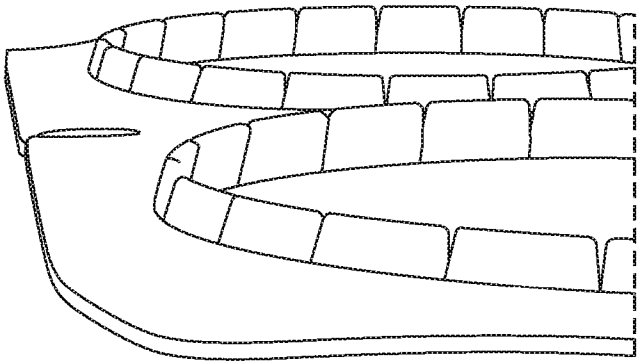
Figure 14A:
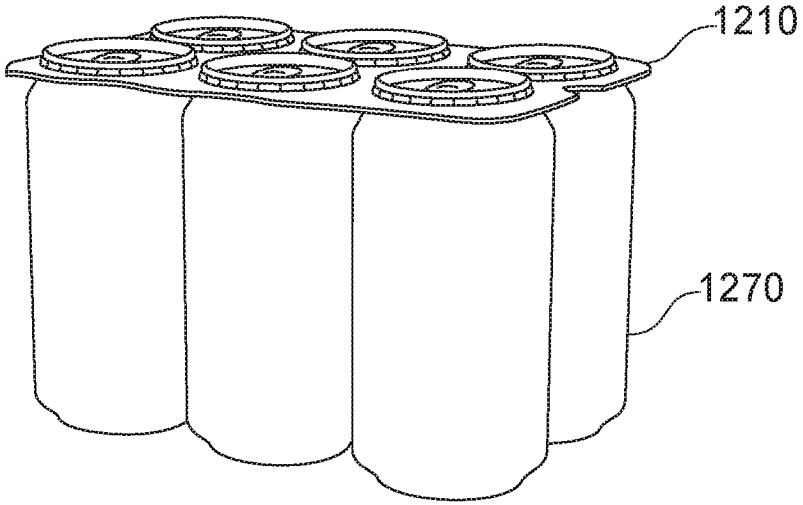
Figure 14B:
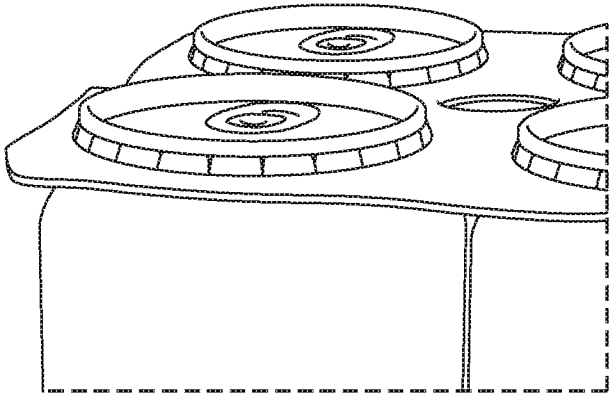

FIG. 13 shows part of a carrier 1210 formed according to a further embodiment, with lugs 1235 located under a can chime 1275.

FIGS. 14A to 14D illustrate a carrier 1310 formed according to a further embodiment and shown unitising a plurality of cans 1370.

Figure 15:
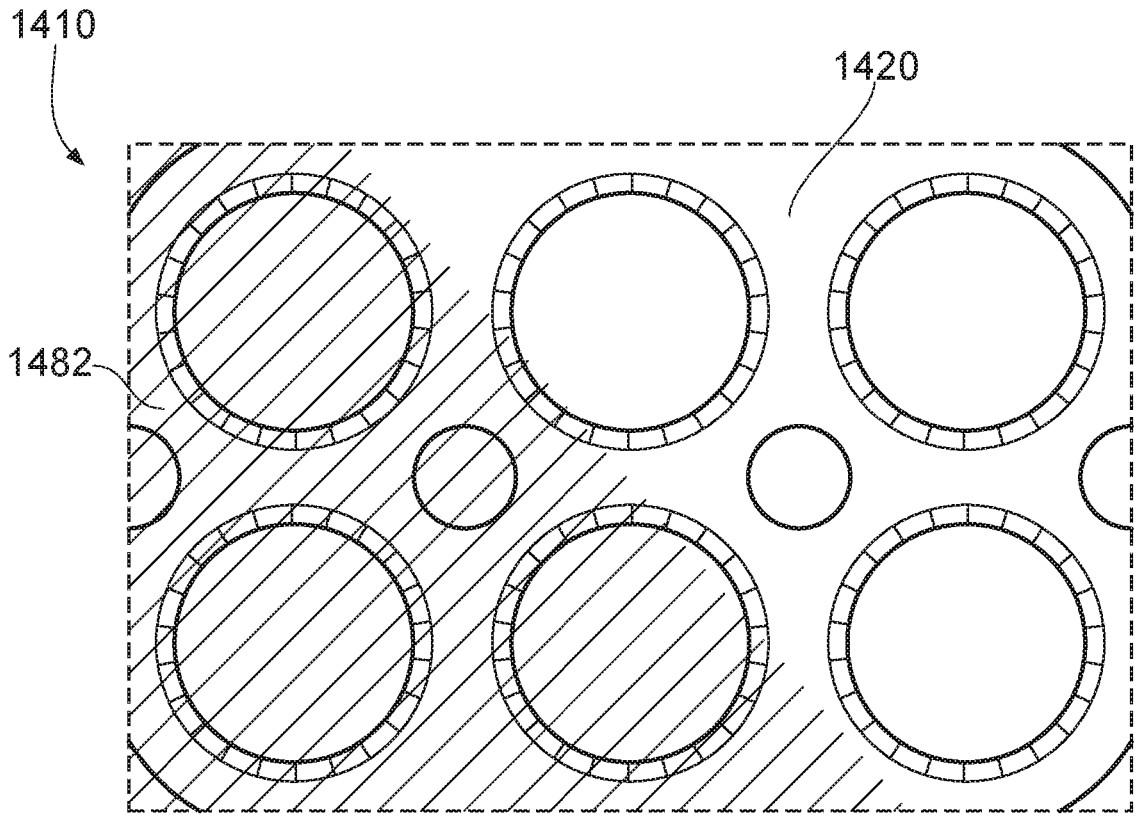
Figure 16:
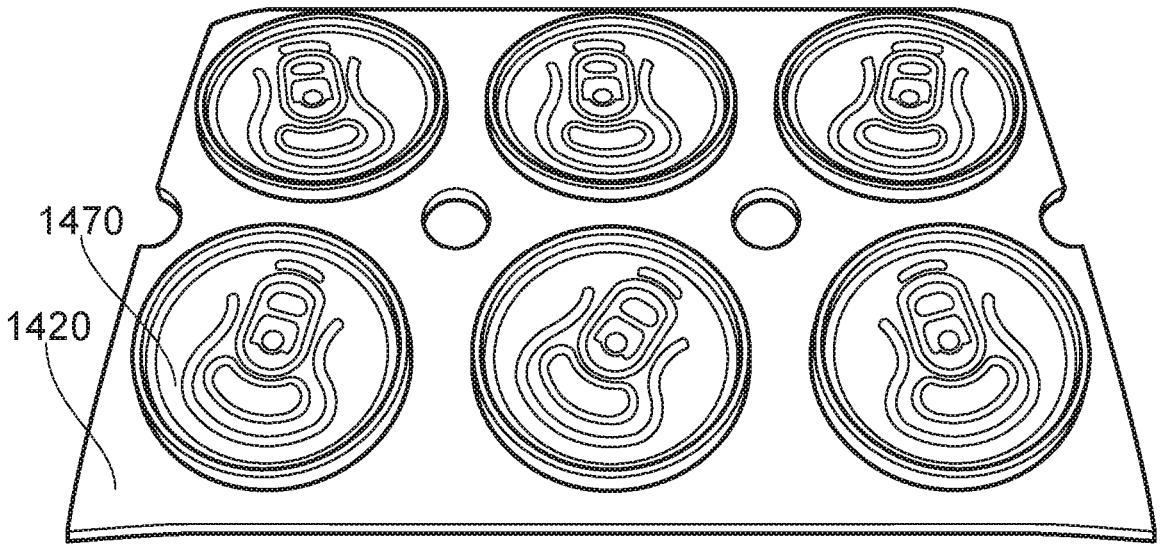

FIG. 15 shows a carrier 1410 formed according to a further embodiment. The carrier 1410 is similar to the carrier 10, 110. In this embodiment a peelable film 1482 is provided and extends across the layer 1420. This means that when the carrier is applied (see FIG. 16) the tops of the cans 1470 are protected. Because the film 1482 is peelable it can easily be removed from the cardboard carrier before recycling.

Figure 17:
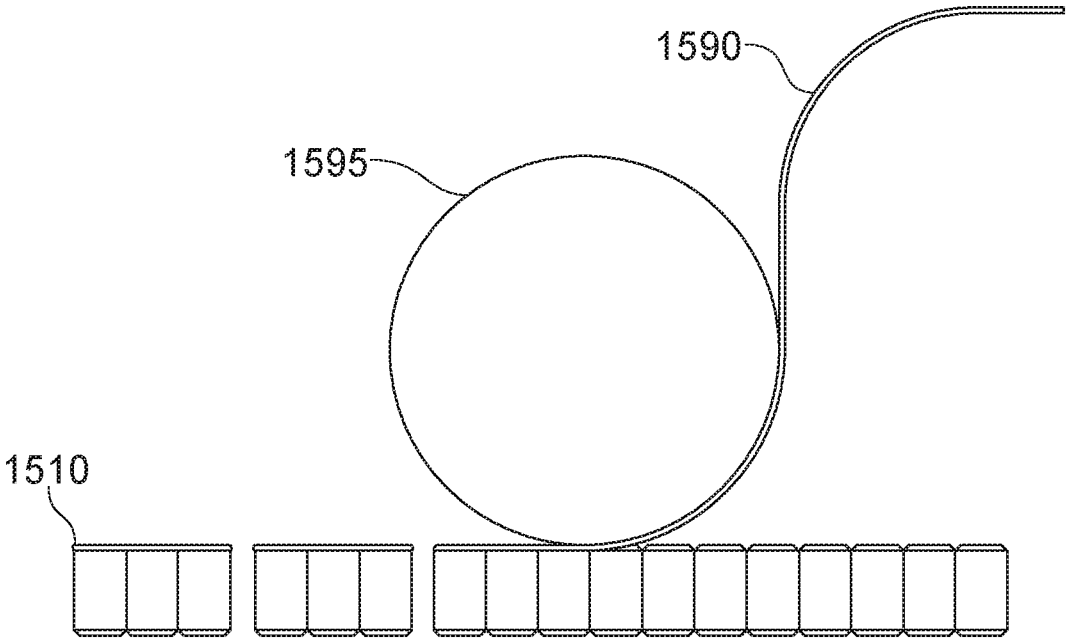

FIG. 17 illustrates a method of applying clip-type carriers. The carriers 1510 are provided as a continuous strip 1590, which approach and move onto a rotary drum 1595. The drum may, for example, include posts which engage manipulation holes.

The drum 1595 causes the carriers to be rolled onto waiting sets of containers (as opposed, for example to pushing them down vertically from above).

To achieve the closest possible fit of the first layer in relation to the second layer in a roll-on system, elliptical apertures (with ellipticity in the application direction) may be used to facilitate "close fitting" whilst allowing clearance for the aperture to pass over the trailing edge of the container as it is applied.

The strip may, for example include perforations, embossed lines or the like to allow separation before, during or after application.

Figure 18:
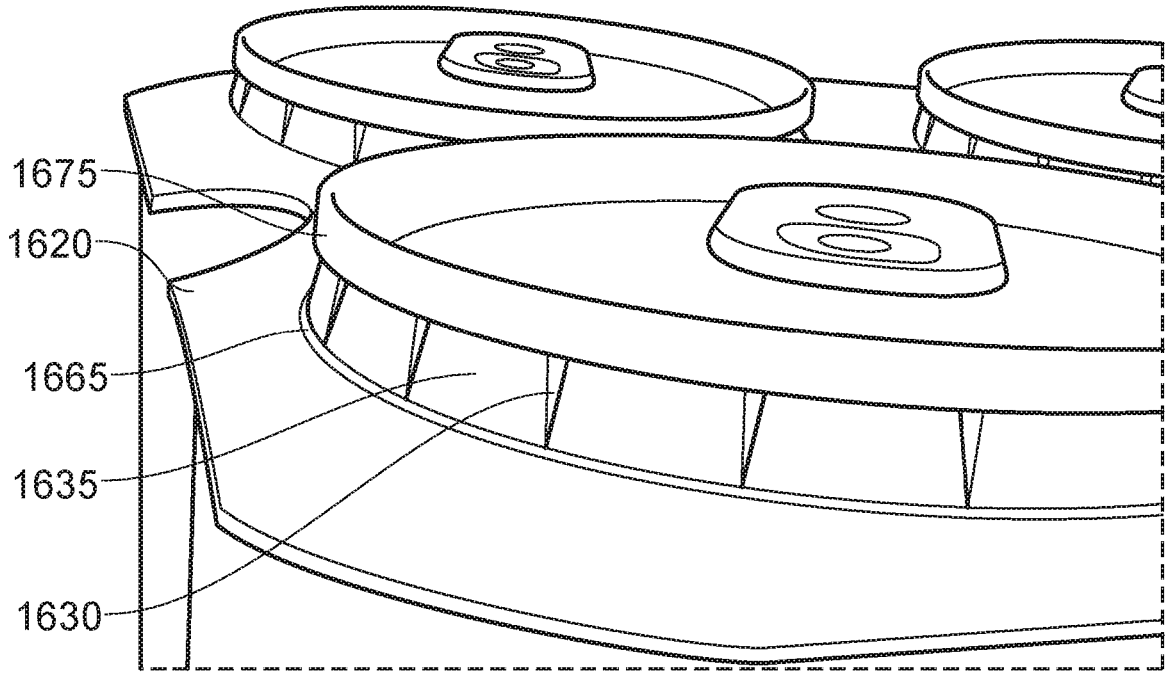
Figure 19:
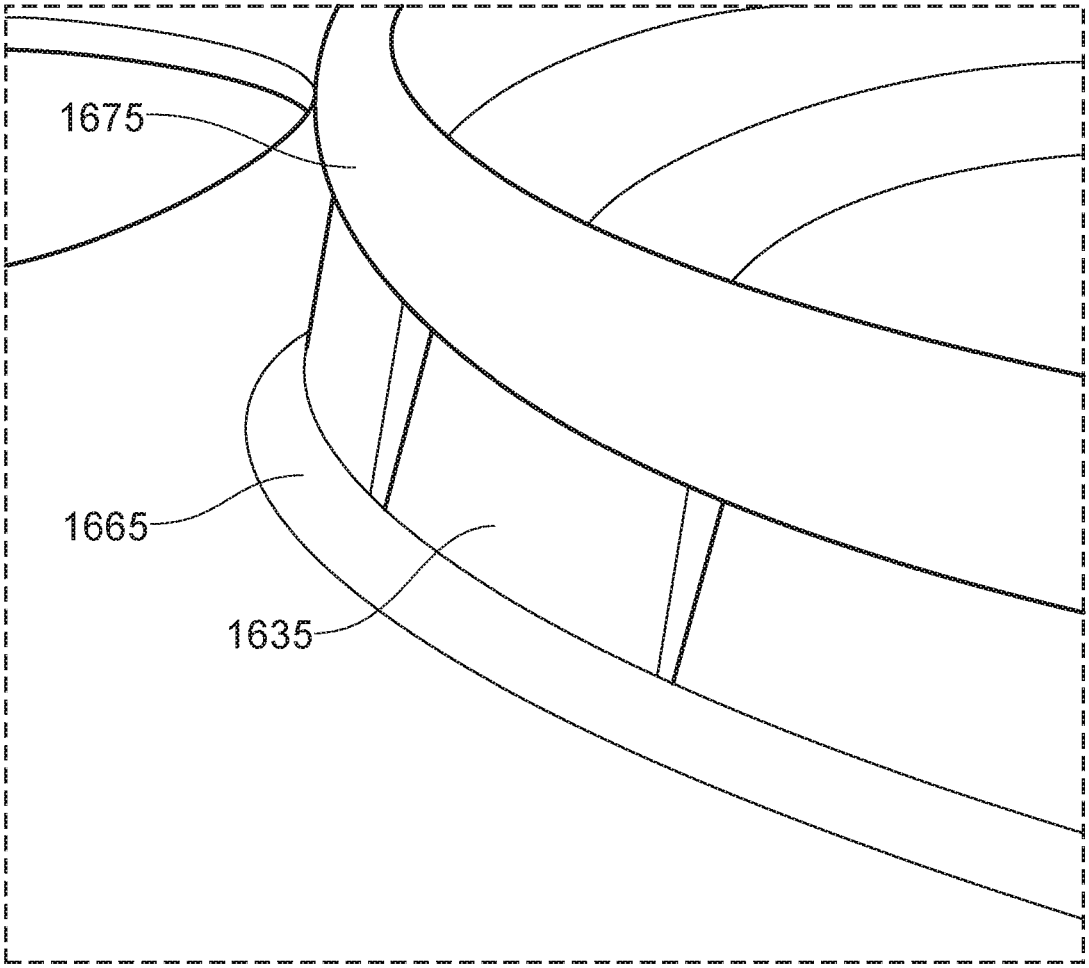

FIGS. 18 and 19 show a carrier formed according to a further aspect of the present invention. The carrier is formed from a lower layer 1615 and an upper layer 1620.

The lower layer 1615 is formed with six (in this embodiment) retaining apertures 1625, provided in two parallel rows of three. Each of the apertures 1625 is generally circular and at their periphery have a plurality of radially extending slits 1630 which define a plurality of retaining lugs 1635.

The upper layer 1620 is formed with apertures 1650 corresponding to respective apertures 1625 of the lower layer 1615.

The circular apertures 1650 are dimensioned using formula: $D1<D2-2T$ to result in formation of a ridge/crease/fillet 1665 when applied, which significantly improves retention.

The lugs 1635 are shown located under a can chime 1675.

Drop tests were carried out on the smaller diameter aperture in top layer of carrier. The drop tests were carried out on 6×500 ml cans at a drop distance of approximately 1".

These tests were performed on the standard 55 mm diameter, smaller 54 mm diameter and the 53.5 mm diameter aperture carriers i.e. $D1+2T>D2$; $D1+2T=D2$; and $D1+2T<D2$. For this test the top of the cans is approximately 54 mm diameter and the board thickness of a single layer is 0.35 mm.

The reduction in the aperture diameter, 53.5 mm combined with the board thickness of 2×0.35 mm creates an aggregated aperture of only 52.8 mm. This is an interference fit over the top of the cans and may require a precise method of application to prevent the non-stretchy cardboard from tearing (e.g. see FIGS. 23 and 24).

| Aperture diameter (mm) | Average number of drops |
|---|---|
| 55 | 7 |
| 54 | 9 |
| 53.5 | 25+ |

The results show a marked improvement in can retention. This is because how the pack works is fundamentally different.

On the designs of FIGS. 1 to 16, for example, the top layer diameter supports the fingers of the lower diameter, helping to prevent them from bending and the pack failing. By reducing the diameter further, it has been found that the amount the fingers extend through the top aperture is reduced (for example approximately 1.9 mm vs 2.75 mm) as a result of the smaller diameter not sitting further down on the conical top of the can. It also creates a reinforcing bead around the fingers. These shorter fingers are less prone to deformation. The difference is in the interference fit of the carrier over the rim of the can. Once the finger deformation becomes critical they can no longer support the cans and pack failure results. On the smaller diameter "undersized" aperture version, due to the interference fit, the deforming fingers prevent the rim of the cans from passing through the carrier aperture. Therefore, in order for the pack to fail the carrier would need to tear. In effect, the revised design achieves a two-stage method of (can) retention.

The perception was that reducing the size of the apertures even further over the initial design, would have a detrimental effect to the pack itself. As there is no stretch available in the cartonboard material, it was suspected that the pack would split as had seen in previous tests. However, surprisingly the deformation and resultant "bead" that is created has improved pack performance as noted above.

Figure 20C:
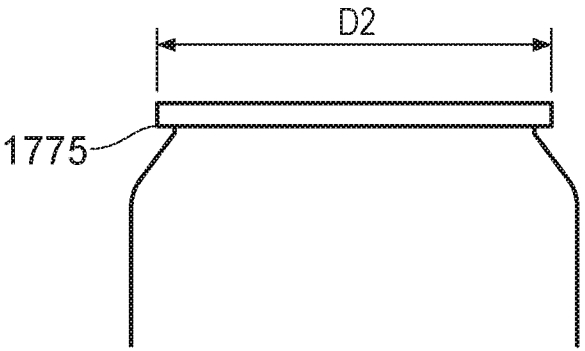
Figure 20B:
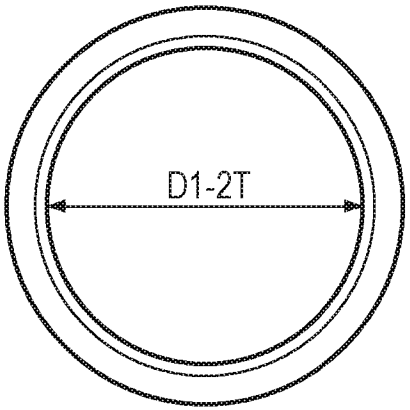
Figure 20A:
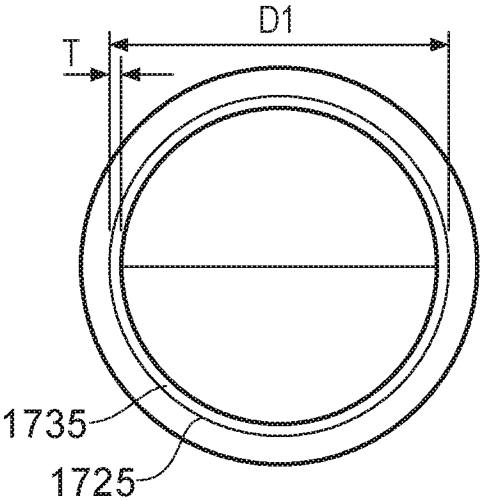

FIG. 20A shows a plan view of an upper layer aperture 1725. Also shown are retaining flaps 1735 folded up and through the aperture 1725 (as they are in use) and having a thickness T. This forms an aggregate container receiving aperture diameter represented as D1−2T in FIG. 20B.

Figure 21:
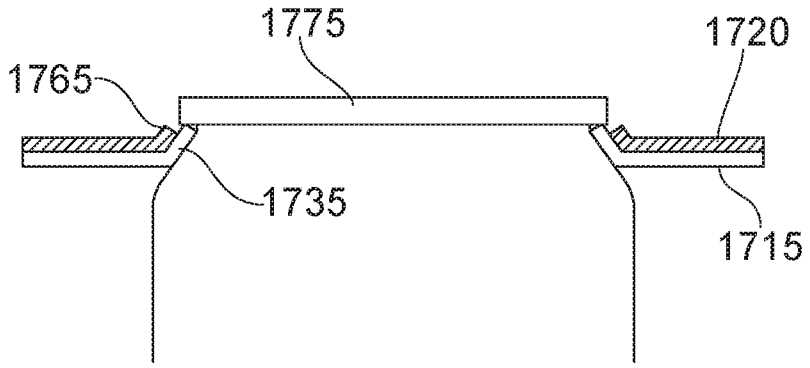

FIG. 20C shows a container (in this embodiment being a metal can) with a chime 1775 having a diameter represented as D2. The aggregate diameter D1−2T is less than D2, so that as the carrier is initially applied onto the container the flaps 1735 are bent up and through the aperture 1725 and continued application causes formation of the bent rim 1765, as shown in FIG. 21.

Figure 22B:
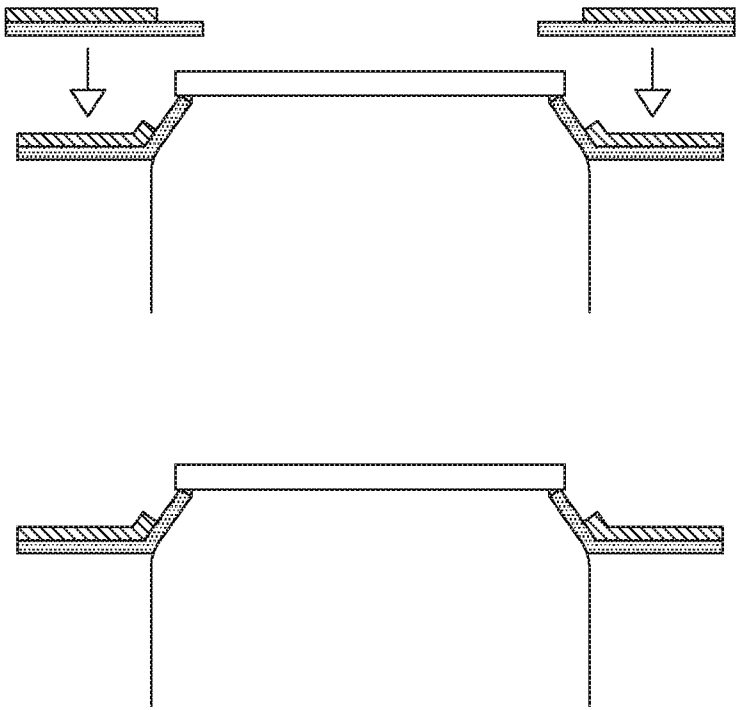
Figure 22A:
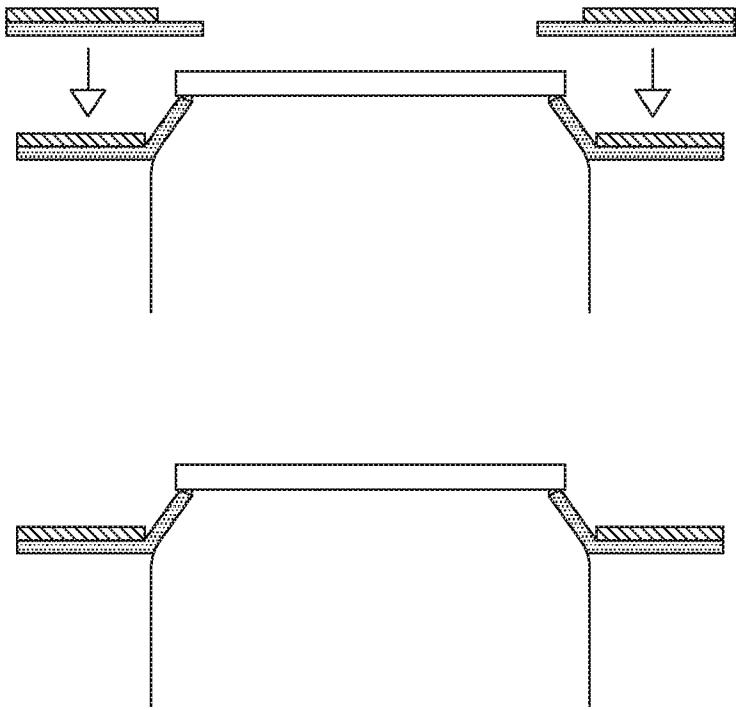

FIGS. 22A and 22B show a comparison of two scenarios: i) D2 is less than or equal to D1−2T, in which case no bent rim is formed; and ii) D2 is greater than D1−2T, in which case a reinforcing rim is formed.

Figure 23:
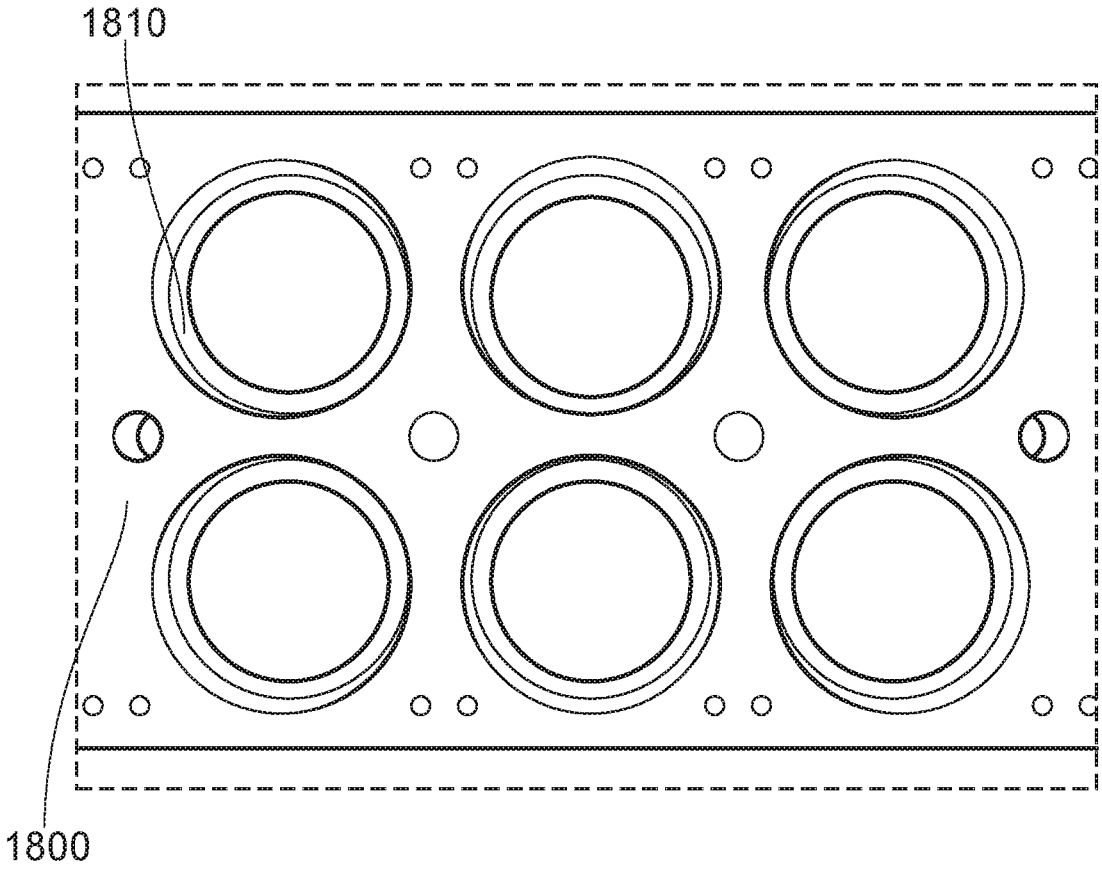
Figure 24:
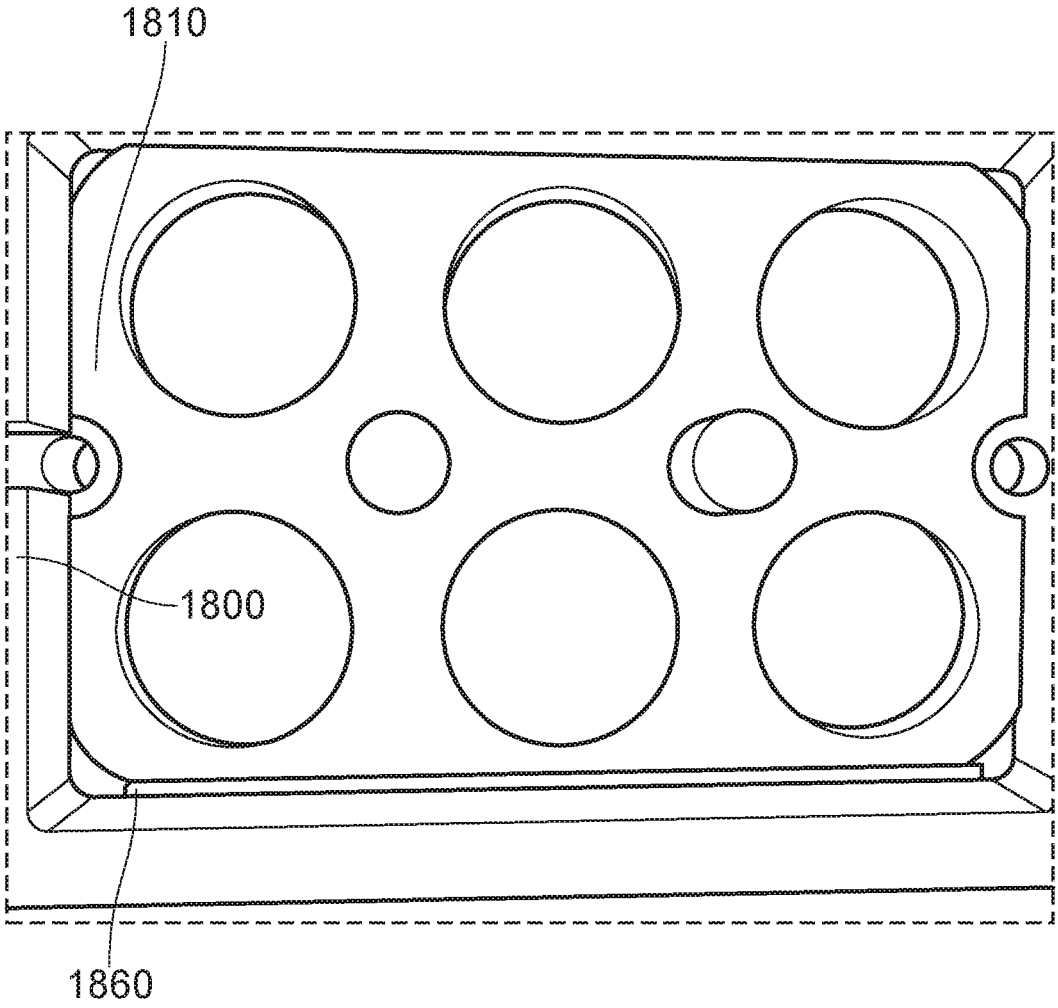

FIGS. 23 and 24: in order to apply the modified carrier of some embodiments effectively it has been found that a close-fitting pusher plate 1800 is required. Further, in order to prevent the corners of the carrier 1810 deforming during application retaining strips 1860 within the tool hold the carrier, which improves application.

These strips take the form of articulated clamps mounted along each edge of the application head/pusher plate 1800. Prior to picking up the carrier the clamps are in a retracted position. As the individual carrier is picked up from a pre-application stack by the pusher plate, the clamps move and grip the edges of the carrier against the underside of the plate. This provides extra support which acts against the forces created during application, preventing flexing and deformation of the carrier, resulting in a more secure pack. These strips may be profiled to avoid contact with the containers during application. Once applied the retaining strips retract, releasing the applied carrier and allowing the next carrier to be picked up and engaged within the application head; the process is then repeated.

Figure 25:
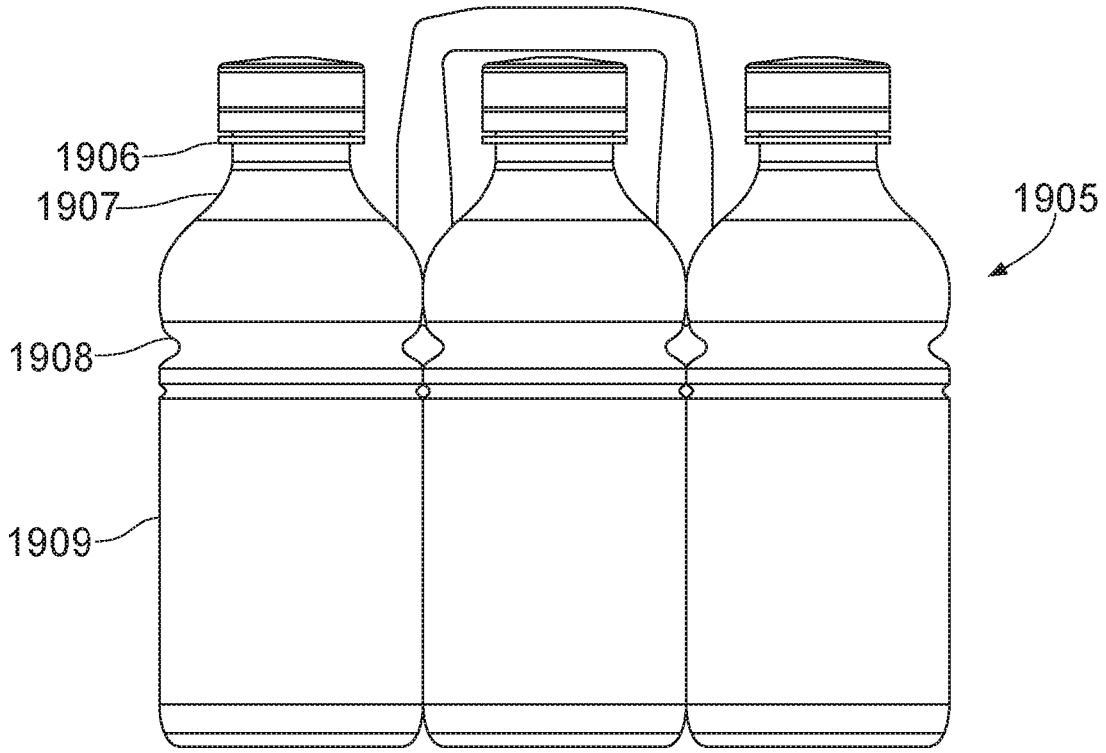

FIG. 25 shows a set of containers 1905. Each container 1905 includes a transfer bead 1906, a conical portion 1907 and a waist 1908 formed in a sidewall 1909.

A carrier formed in accordance with the present invention could, for example, be configured to fit under the bead 1906, in which case the diameter of the bead 1906 would be D2. Alternatively a carrier could be configured to fit into the waist 1908, in which case the diameter of the sidewall 1909 would be D2 (the "overdimension" that causes formation of the aperture bent rim).

Although illustrative embodiments of the invention have been disclosed in detail herein, it is understood that the invention is not limited to the precise embodiments shown and that various changes and modifications can be effected therein by one skilled in the art without departing from the scope of the invention.

The invention claimed is:

1. A clip-type carrier for packaging articles of the type having a rim, chime, waist, undercut or the like, the clip-type carrier comprising a first layer having a plurality of generally circular apertures and a second layer having a plurality of respective locking apertures, the locking apertures are provided with a plurality locking tabs which fold through the generally circular apertures and engage an article rim or the like in use, wherein an interior periphery of the circular apertures of the first layer is formed with or configured to provide a reinforcing rim which supports the locking tabs so as to resist deformation thereof, the reinforcing rim having an inner edge offset in a vertical direction relative to the rest of the first layer so as to be located closer to an inner end of each of the plurality of locking apertures in the vertical direction compared to the rest of the first layer.

2. The carrier of claim 1, wherein the reinforcing rim is formed as the carrier is applied.

3. The carrier of claim 1, wherein a subtractive aperture diameter (D1) minus twice the thickness of the locking tabs is less than a diameter of the article rim.

4. The carrier of claim 1, wherein D1−2T<D2, where D1 is an upper aperture diameter, D2 is a diameter of the article rim and T is a thickness of the second layer locking tabs.

5. The carrier of claim 1, wherein a diameter D1 of the circular apertures are dimensioned according to a formula D1<D2−at least 2*T, where D2 is a diameter of the article rim and T is a thickness of the locking tabs of the second layer.

6. The carrier of claim 5, wherein D1=D2−(4*T).

7. The carrier of claim 1, wherein the first and second layers are formed separately and are secured or are securable together.

8. The carrier of claim 1, wherein the first and second layers are adhered, bonded or glued together in advance of application or at the time of application.

9. The carrier of claim 6, wherein the layers are secured together using re-pulpable adhesive.

10. The carrier of claim 1, wherein each locking tab is a foldable flap.

11. The carrier of claim 1, wherein the apertures in the first layer provide a fold point for the locking tabs.

12. The carrier of claim 1, wherein apertures of the second layer are castellated to provide the locking tabs.

13. The carrier of claim 1, wherein the first and/or second layers are formed from cardboard material.

14. The carrier of claim 1, wherein the first and second layers are generally rectangular or generally square sheets.

15. The carrier of claim 1, further comprising one or more marketing panels formed along one or more sides of the first and/or second layers.

16. The carrier of claim 1, further comprising a handle.

17. The carrier of claim 1, further comprising a cover film for covering the first layer.

18. The carrier of claim 1, wherein the first and/or second layers include one or more folds that form panels or flaps, and in which the fold includes tension means for causing tension therein in a folded condition.

19. The carrier of claim 1 in combination with one or more packaging articles.

* * * * *